US007976017B2

(12) United States Patent
Shiohara

(10) Patent No.: US 7,976,017 B2
(45) Date of Patent: Jul. 12, 2011

(54) SHEET-SUPPLY APPARATUS, AND IMAGE RECORDING APPARATUS INCLUDING SHEET-SUPPLY APPARATUS

(75) Inventor: Yukio Shiohara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 514 days.

(21) Appl. No.: 11/563,441

(22) Filed: Nov. 27, 2006

(65) Prior Publication Data

US 2007/0120316 A1 May 31, 2007

(30) Foreign Application Priority Data

Nov. 29, 2005 (JP) ..... 2005-343195

(51) Int. Cl.
*B65H 1/00* (2006.01)

(52) U.S. Cl. ..... 271/171

(58) Field of Classification Search ..... 271/171, 271/145

See application file for complete search history.

(56) References Cited

U.S. PATENT DOCUMENTS

| | | | | |
|---|---|---|---|---|
| 6,722,647 | B2 * | 4/2004 | Kato et al. | 271/3.03 |
| 6,776,405 | B2 * | 8/2004 | Eskey | 271/9.08 |
| 7,527,258 | B2 * | 5/2009 | Ito | 271/171 |
| 2006/0113725 | A1 * | 6/2006 | Ito | 271/171 |

FOREIGN PATENT DOCUMENTS

| | | | |
|---|---|---|---|
| JP | S61-277525 | A | 12/1986 |
| JP | H01-058537 | U | 4/1989 |
| JP | H04-091941 | U | 8/1992 |
| JP | 5-24723 | * | 2/1993 |
| JP | H08-272167 | A | 10/1996 |
| JP | 10-291695 | * | 11/1998 |
| JP | H10-291695 | A | 11/1998 |
| JP | 2000-016661 | A | 1/2000 |

* cited by examiner

*Primary Examiner* — Stefanos Karmis
*Assistant Examiner* — Thomas A Morrison
(74) *Attorney, Agent, or Firm* — Baker Botts L.L.P.

(57) ABSTRACT

A sheet-supply apparatus, including a sheet accommodating portion which includes a support portion that supports, on a support surface thereof, a plurality of cut sheets such that the cut sheets are stacked on each other; a sheet-supply roller which is adapted to supply the cut sheets accommodated in the sheet accommodating portion, one by one in a sheet-supply direction; a main side guide which is slidably movable on the support portion in a widthwise direction of the sheet accommodating portion perpendicular to the sheet-supply direction and which guides a side edge of each of the cut sheets accommodated in the sheet accommodating portion, the side edge being parallel to the sheet-supply direction; and a sub-side guide which is located inside of the main side guide in the widthwise direction and which is pivotable about a pivot axis between a standing position and a lying position based on the widthwise sliding movement of the main side guide.

20 Claims, 12 Drawing Sheets

SHEET-SUPPLY APPARATUS, AND IMAGE RECORDING APPARATUS INCLUDING SHEET-SUPPLY APPARATUS

The present application is based on Japanese Patent Application No. 2005-343195 filed on Nov. 29, 2005, the contents of which are incorporated herein by reference.

BACKGROUND OF THE INVENTION

1. Field of the Invention

The present invention relates to a sheet-supply apparatus and an image recording apparatus which includes a printer, a copier, a facsimile machine, and the like employing the sheet-supply apparatus.

2. Discussion of Related Art

There has been known a sheet-supply apparatus which is employed by an image recording apparatus which supplies, one by one, a plurality of recording sheets as cut sheets to a recording portion for an image recording. As disclosed in JP-U-4-91941 and JP-A-2000-16601, there has been known a sheet-supply cassette of a universal-type to record an image on different types of recording sheets.

For example, JP-U-4-91941 discloses a sheet-supply apparatus including: a sheet-supply cassette which has a generally box-like shape; a press plate by which recording sheets stacked on the sheet-supply cassette are pressed; and a plurality of guide portions which are provided on a bottom plate of the sheet-supply cassette and which are movable relative to the bottom plate according to the sizes of the recording sheets. The guide portions are pivotable between a standing position and a lying position, so that the guide portions protrude from the press plate when the guide portions are used (in the standing position) while the guide portions are accommodated beneath the press plate when the guide portions are not used (in the lying position).

JP-A-2000-16601 discloses a sheet-supply apparatus including: a sheet-supply cassette which has a box-like shape and which is open upward; and a movable guide plate which is provided on a bottom plate of the sheet-supply cassette and which is pivotable between a standing position and a lying position. The movable guide plate is arranged to be accommodated in a recessed portion formed in the bottom plate when it is in the lying position, such that the recording sheets with a large size are accommodated in the sheet-supply cassette and arranged to be moved to the standing position, such that the recording sheets having a smaller size are guided.

SUMMARY OF THE INVENTION

In the light of the above-described technical background, the present invention has been developed. It is therefore an object of the present invention to provide a sheet-supply apparatus having a simple structure which can accommodate and supply the cut sheets with different sizes. It is another object of the present invention to provide an image recording apparatus which can record images on the cut sheets with different sizes.

According to a first aspect of the present invention, there is provided a sheet-supply apparatus comprising: a sheet accommodating portion which includes a support portion that supports, on a support surface thereof, a plurality of cut sheets such that the cut sheets are stacked on each other; a sheet-supply roller which is adapted to supply the cut sheets accommodated in the sheet accommodating portion, one by one in a sheet-supply direction; a main side guide which is slidably movable on the support portion in a widthwise direction of the sheet accommodating portion perpendicular to the sheet-supply direction and which guides a side edge of each of the cut sheets accommodated in the sheet accommodating portion, the side edge being parallel to the sheet-supply direction; and a sub-side guide which is located inside of the main side guide in the widthwise direction and which is pivotable about a pivot axis between a standing position and a lying position based on the widthwise sliding movement of the main side guide.

In the sheet-supply apparatus in accordance with the first aspect of the present invention, each of the cut sheets having different sizes in the widthwise direction of the sheet accommodating portion can be guided by the main side guide and the sub-side guide. When a size of the cut sheets accommodated in the sheet accommodating portion is changed, the main side guide is slid in the widthwise direction so as to be able to guide the cut sheets with different sizes. The sub-side guide can be easily pivoted between the standing position and the lying position based on the widthwise sliding movement of the main side guide. In a case where a range of the widthwise sliding movement of the main side guide is limited, the sub-side guide can effectively guide the cut sheets having a smaller size in the widthwise direction than the cut sheets having a size which can be guided by the main side guide, resulting in a high usability of the sheet-supply apparatus. The size of the cut sheets guided by the sub-side guide is not limited to one depending upon embodiments.

According to a second aspect of the present invention, there is provided an image recording apparatus comprising: a main body; the sheet-supply apparatus according to the first aspect of the present invention which is provided in the main body; a recording portion which is provided in the main body and records an image on the cut sheets supplied from the sheet-supply apparatus; a sheet-feed passage which is provided in the main body and through which each of the cut sheets is fed to the recording portion; and wherein the sheet accommodating portion of the sheet-supply apparatus is provided in a lower-portion of the main body beneath the recording portion, such that the sheet supply apparatus is advanced and retracted relative to the main body in the sheet-supply direction.

Since the image recording apparatus in accordance with the second aspect of the present invention employs the sheet-supply apparatus in accordance with the first aspect of the present invention, the image recording apparatus can enjoy the same advantages as the above-described advantages of the sheet-supply apparatus.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
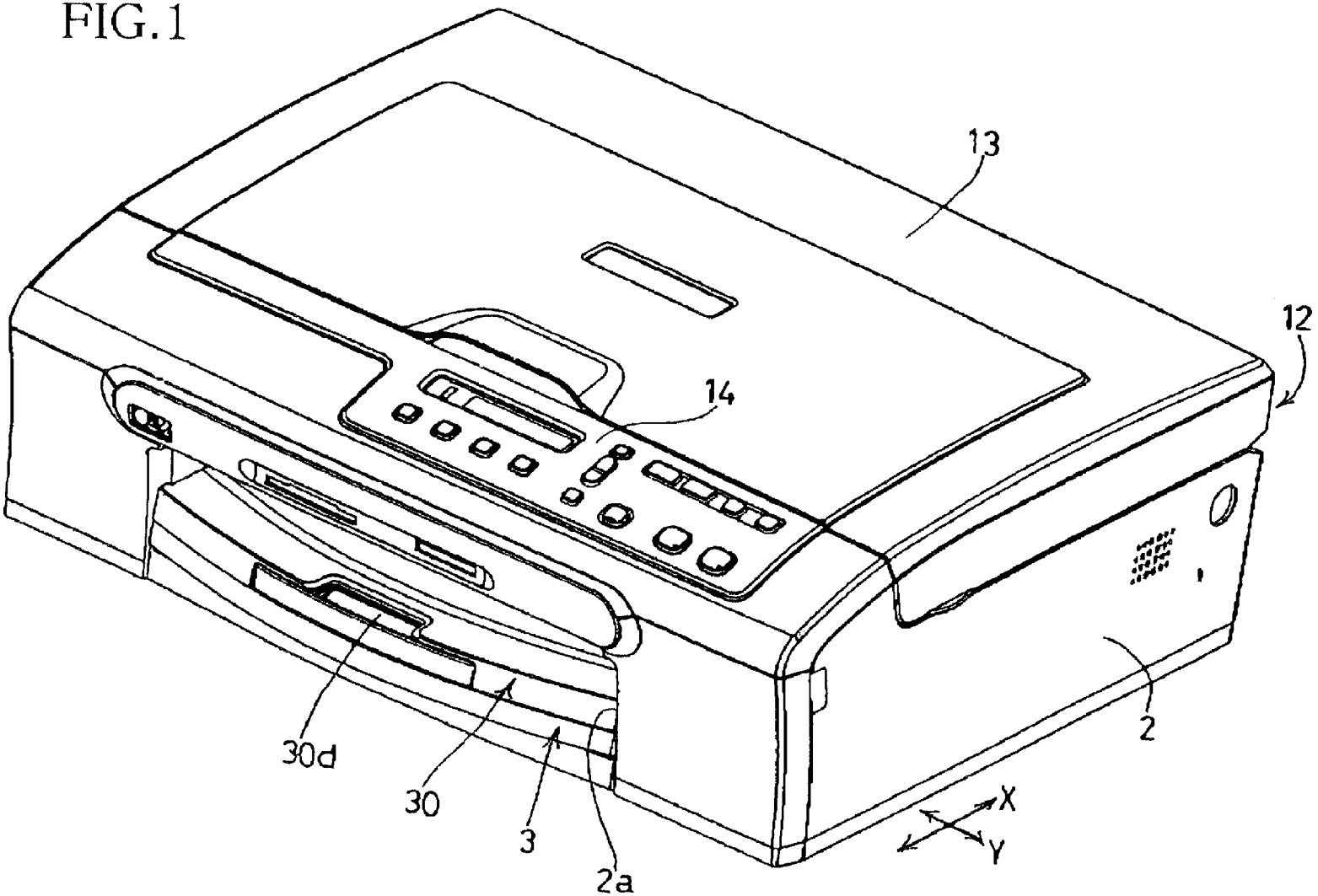
FIG. 1 is a perspective view of an image recording apparatus as an embodiment of the present invention.
Figure 2:
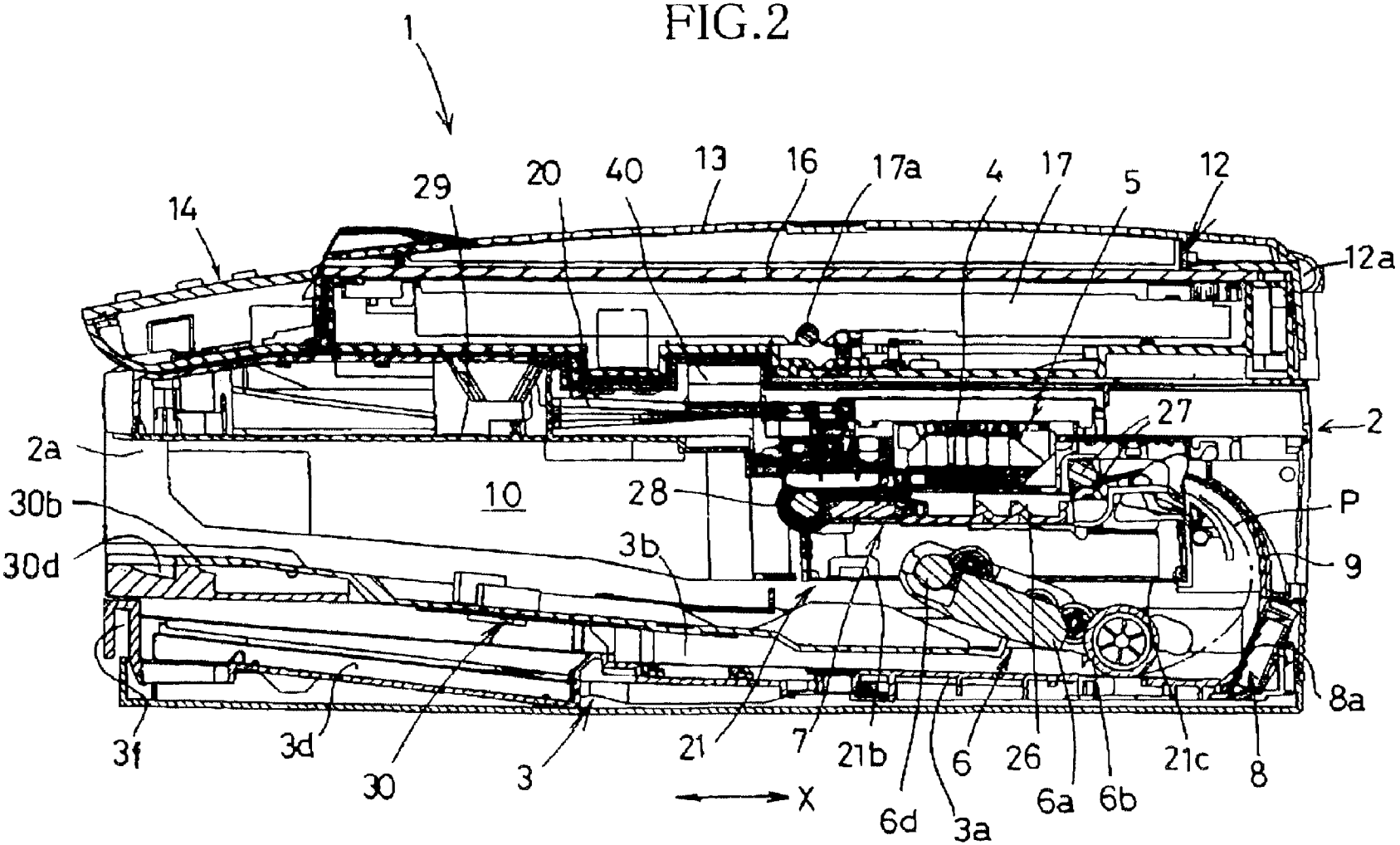
FIG. 2 is a side elevational view in cross-section showing the image recording apparatus.
Figure 3:
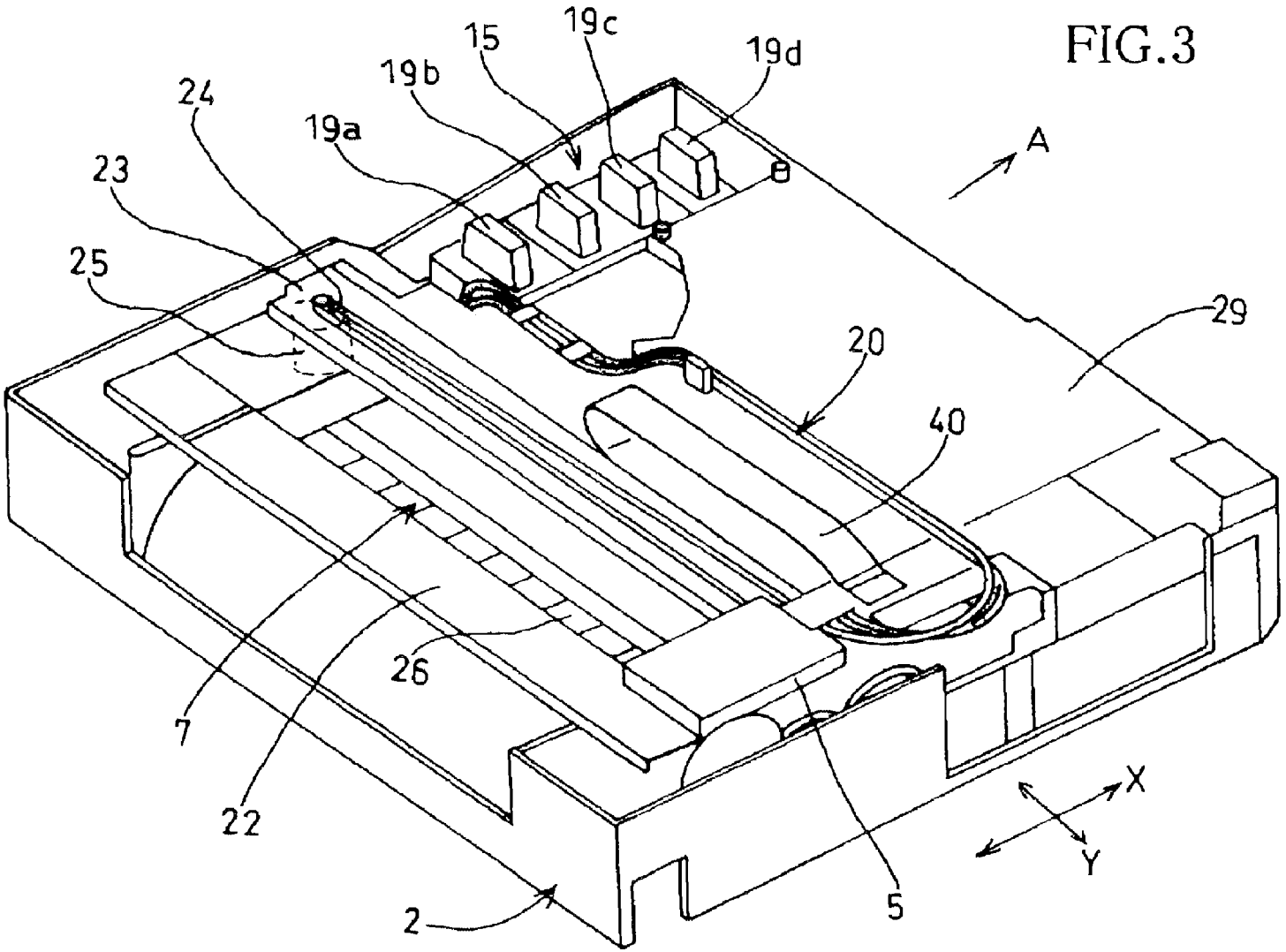
FIG. 3 is a perspective view of a main body of the image recording apparatus in a state in which an upper cover member is removed.

Hereinafter, there will be described preferred embodiments of the present invention by reference to the drawings. FIGS. 1 through 3 show an image recording apparatus to which the present invention is applied and FIGS. 4 through 10 show a sheet-supply apparatus to which the present invention is applied.

The image recording apparatus 1 is a so-called "multi-function device (MFD)" which has a printer function, a copier function, a scanner function, and a facsimile machine function. As shown in FIGS. 1 and 2, the image recording apparatus 1 includes: a housing 2 as a main body that is formed by injection molding of a synthetic resin; a first sheet-supply cassette 3 as a first medium cassette which is insertable into or retractable from a front opening 2*a* provided on a front side (left-hand side in FIG. 2) of a lower portion of the housing 2; and a second sheet-supply cassette 30 (described in detail later) as a second medium cassette which is connected to or mounted on an upper surface of the first sheet-supply cassette 3 and which is slidably movable (slidable in an X-axis direction in FIG. 2). In the following description of each of the components, such as the housing 2, and the first and the second sheet-supply cassettes 3, 30, a portion, an end, or a side of the each component which is located nearer to the front opening 2*a* will be referred to as a front portion, a front end, or a front side of the each component, and a portion, an end, or a side of the each component which is located opposite to the front opening 2*a* will be referred to as a rear portion, a rear end, or a rear side of the each component.

In a top portion of the housing 2, there is provided an image reading device 12 to read an original image from an original sheet in the copier or facsimile-machine function. The image reading device 12 is connected via hinges (not shown) to a rear end of the housing 2 so as to be pivotable upward and downward about the hinges. An original-sheet cover member 13 which is provided to cover an upper surface of the image reading device 12 is connected via hinges 12*a* to a rear end of the image reading device 12 such that the cover member 13 is pivotable upward and downward about the hinges 12*a*.

In the top portion of the housing 2, there is provided an operation panel 14 that is located in front of the image reading device 12 and includes various sorts of operation keys and a liquid-crystal display. The image reading device 12 additionally includes: an original-sheet support glass plate 16 that supports, on an upper surface thereof, an original sheet when a user opens the cover member 13 by pivoting the same 13 upward and places an original sheet on the upper surface of the support glass plate 16; and an image scanner (e.g., a contact image sensor (CIS)) 17 that is provided below the support glass plate 16 and is reciprocateable along a guide shaft 17*a* extending in a main scanning direction, i.e., a Y-axis direction in FIGS. 1 and 3, so as to read an original image borne by the original sheet. The Y-axis direction is perpendicular to the sheet plane of FIG. 2.

Under the operation panel 14 and the image reading device 12, within respective projected areas thereof, there are provided a recording portion 7, a sheet discharging portion 10, and a ink reservoir portion 15 that is provided on one side of the sheet discharging portion 10.

As shown in FIG. 2, the recording portion 7 is provided between a main frame 21 and two elongate plate-like first and second guide members 22, 23 (FIG. 3) which are respectively supported by two side walls of the main frame 21 and which extend in the Y-axis direction (i.e., the main scanning direction). The main frame 21 has a box-like structure and opens upward The recording portion 7 includes a carriage 5 that supports a recording head 4 and bridges the first and the second guide members 22, 23 such that the carriage 5 is slidable and reciprocateable on the same 22, 23. The first guide member 22 is located on an upstream side in a sheet-supply direction (in a direction indicated by an arrow A in FIG. 3) and the second guide member 23 is located on a downstream side in the sheet-supply direction. The sheet-supply direction is a direction in which the recording sheet P is supplied.

As shown in FIG. 3, the recording portion 7 includes: a timing belt 24 which is provided on an upper surface of the second guide member 23 such that the timing belt 24 is wound on pulleys and such that the timing belt 24 extends in the Y-axis direction (i.e., the main scanning direction) for reciprocating the carriage 5; a carriage (CR) motor 25 which drives the timing belt 24 and which is fixed to a lower surface of the second guide member 23; a flat platen 26 which extends in the Y-axis direction such that the platen 26 is, opposed to a lower surface of the recording head 4 mounted on the carriage 5 and which is fixedly positioned above a bottom plate 21*b* of the main frame 21 between the two guide members 22,23; and a belt-like encoder strip, not shown, which extends in the Y-axis direction and detects a current position of the carriage 5 in the Y-axis direction. The encoder strip has a detection surface in which a plurality of slits are formed at a regular interval in the Y-axis direction, and is provided such that the detection surface is vertical. In the present embodiment, the carriage motor 25 is a DC motor. However, the DC motor may be replaced with other kinds of motors such as a stepping motor.

As shown in FIGS. 2 and 3, a partition plate 29 made of a synthetic resin is formed integrally with the housing 2, such that the partition plate 29 is located above the sheet discharging portion 10. The partition plate 29 extends from the lower surface of the second guide member 23 to the front opening 2*a* which functions also as a sheet-discharge opening.

As shown in FIG. 3, the ink reservoir portion 15 opening upward in the housing 2 can accommodate a plurality of ink cartridges 19 which are arranged in a row in the X-axis direction and which are detachable upward. In the present embodiment, the ink reservoir portion 15 accommodates four ink cartridges 19*a*, 19*b*, 19*c*, 19*d* storing black (B), cyan (C), magenta (M), and yellow (Y) inks, respectively, for full-color recording. Each of the cartridges 19*a*, 19*b*, 19*c*, 19*d* has a generally rectangular box-like structure having a small area in its plan view and a large height.

The ink cartridges 19 (19*a*, 19*b*, 19*c*, 19*d*) are connected to the ink jet recording head 4 via respective four ink supply tubes 20. When more than four colors, such as six or eight colors, of inks are used, the ink reservoir portion 15 may be constituted to accommodate the ink cartridges 19 whose number corresponds to that of ink colors. In this instance, the number of the ink supply tubes 20 can be increased correspondingly.

As shown in FIG. 3, the ink supply tubes 20 are tied up at their proximal portions in the vicinity of one end portion of the ink reservoir portion 15 and extend in the Y-axis direction from one end (i.e., a left-side end in FIG. 3) of the plate 29 to the opposite end (i.e., a right-side end in FIG. 3) of the same 29. In this instance, the proximal portions of all of the ink supply tubes 20 are arranged, side by side, on a substantially horizontal upper surface of the partition plate 29. The ink supply tubes 20 are supported at least portions thereof (e.g., at intermediate portions thereof) by the upper surface of the partition plate 29.

In the recording portion 7, outside an image recording area corresponding to a width (a short side) of the recording sheets P being conveyed, there are provided an ink tray portion (not shown) located on one side, and a maintenance unit (not shown) on the other side. Accordingly, at a flushing position where the recording head 4 is opposed to the ink tray portion, the recording head 4 periodically ejects droplets of inks during a recording operation, so as to prevent nozzles of the recording head 4 from being closed by poor-quality inks. The ejected ink droplets are received by the ink tray portion. In the maintenance unit, when the carriage 5 is located at a waiting position, a nozzle surface (a lower surface) of the recording head 4 is covered by a cap portion (not shown) of the maintenance unit for performing a recovery operation to selectively suck the different colors of inks, and to remove air bubbles in a buffer tank (not shown) on the recording head 4. When the carriage 5 is moved toward the maintenance unit in the Y-axis direction, the nozzle surface is wiped by a cleaner (a wiper blade) for cleaning the nozzle surface.

As shown in FIG. 3, there is provided a flexible flat cable 40 through which are transmitted command signals from a control portion (not shown) provided at the housing 2 for ejecting droplets of the inks selectively from the nozzles of the recording head 4 mounted on the carriage 5. The flexible flat cable 40 is provided at an area (a movable area, an untied area, or an unrestricted (free) area) where the ink supply tubes 20 are moved, such that the flexible flat cable 40 extends generally in parallel with a direction of extension of the ink supply tubes 20.

As shown in FIG. 2, two register rollers (convey rollers) 27 are provided on an upstream side of the platen 26. The two register rollers cooperate with each other to pinch and feed (convey) the recording sheet P to a space below the lower surface of the recording head 4. On a downstream side of the platen 26, there are provided two discharge rollers 28 that cooperate with each other to feed the recorded sheet P to the sheet discharging portion 10.

Figure 4:
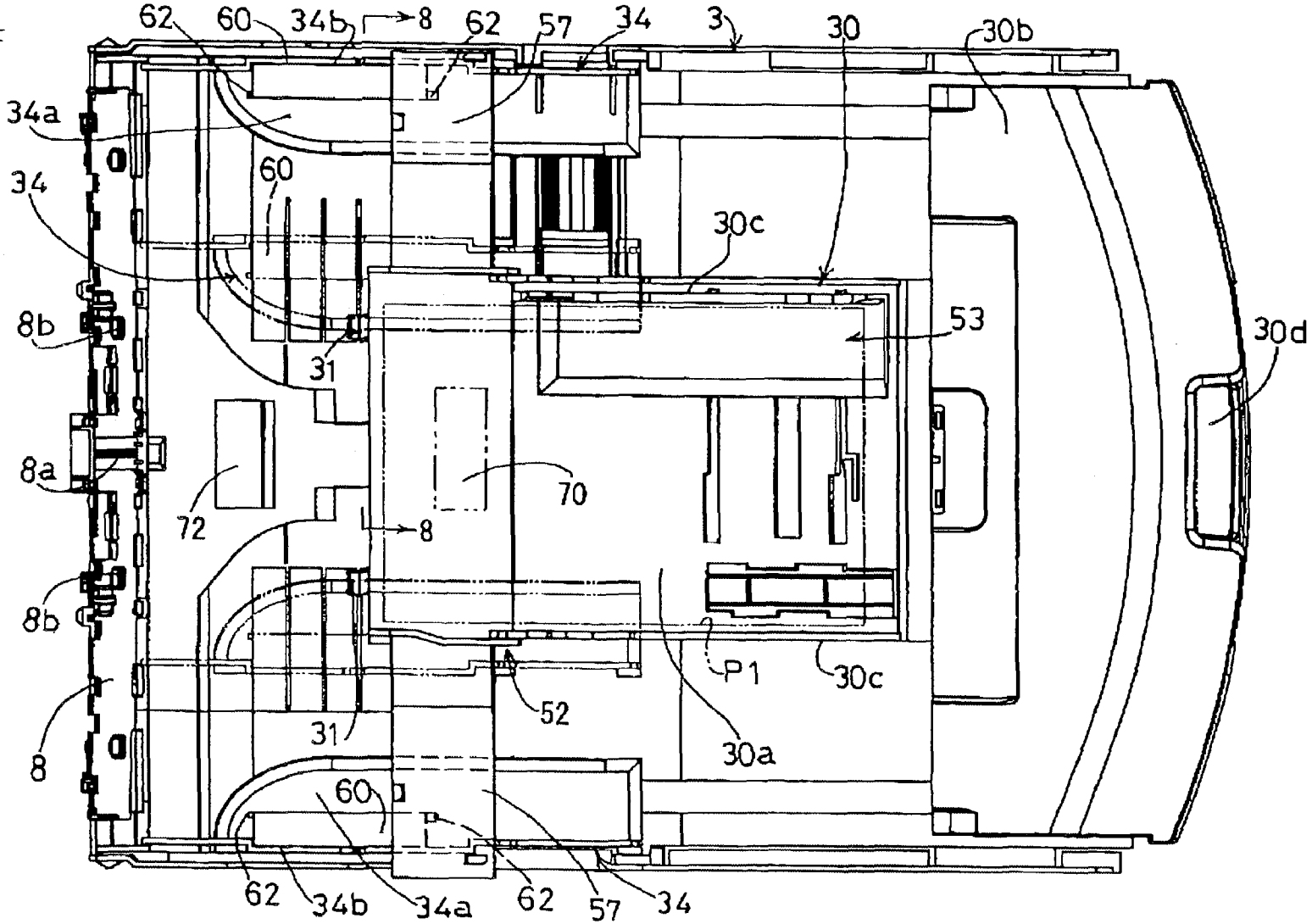
FIG. 4 is a plan view showing a state in which a second medium cassette is located at a sheet-supply position above a first medium cassette.

Next, there will be described in detail constructions of the sheet-supply apparatus. In the present embodiment, as shown in FIGS. 2 and 4-7, the sheet-supply apparatus includes the first and the second sheet-supply cassettes 3, 30. The first sheet-supply cassette 3 includes a first support portion 3*b* which can support, on a support surface thereof a plurality of the cut recording sheets P such that the sheets P are stacked on each other. The recording sheets P supported by the first support portion 3*b* are supplied by a sheet-supply means 6 one by one to the recording portion 7. The second sheet-supply cassette 30 is provided above the first support portion 3*b* of the first sheet-supply cassette 3 so as to be movable relative to the first sheet-supply cassette 3 between an advanced position and a retracted position. The second sheet-supply cassette 30 includes a second support portion 30*a* which can support, on a support surface thereof, a plurality of cut recording sheets P1 such that the sheets P1 are stacked on each other. As shown in FIG. 4, the recording sheets P1 have a smaller width as measured in a widthwise direction of the first and second sheet-supply cassettes 3, 30 than a width of the recording sheets P as measured in the widthwise direction which can be fully accommodated in the first sheet-supply cassette 3.

As shown in FIG. 2, the sheet-supply means 6 includes a sheet-supply arm 6*a*, a sheet-supply roller 6*b*, and a drive shaft 6*d*. The drive shaft 6*d* is supported rotatably in shaft holes formed respectively in a side plate (not shown) of the main frame 21 and a pair of shaft support plates (not shown). A leading end of the drive shaft 6*d* is inserted into a base portion of the sheet-supply arm 6*a* such that the drive shaft 6*d* extends in the Y-axis direction. When the drive shaft 6*d* is driven to rotate, the sheet-supply roller 6*b* is arranged to rotate in a predetermined direction (in a counterclockwise direction in FIG. 2) via a gear transmission mechanism (not shown) provided in the sheet-supply arm 6*a*. Also, the sheet-supply arm 6*a* is biased downwardly pivoted by a biasing means (e.g., a torsion spring), not shown.

Figure 5:
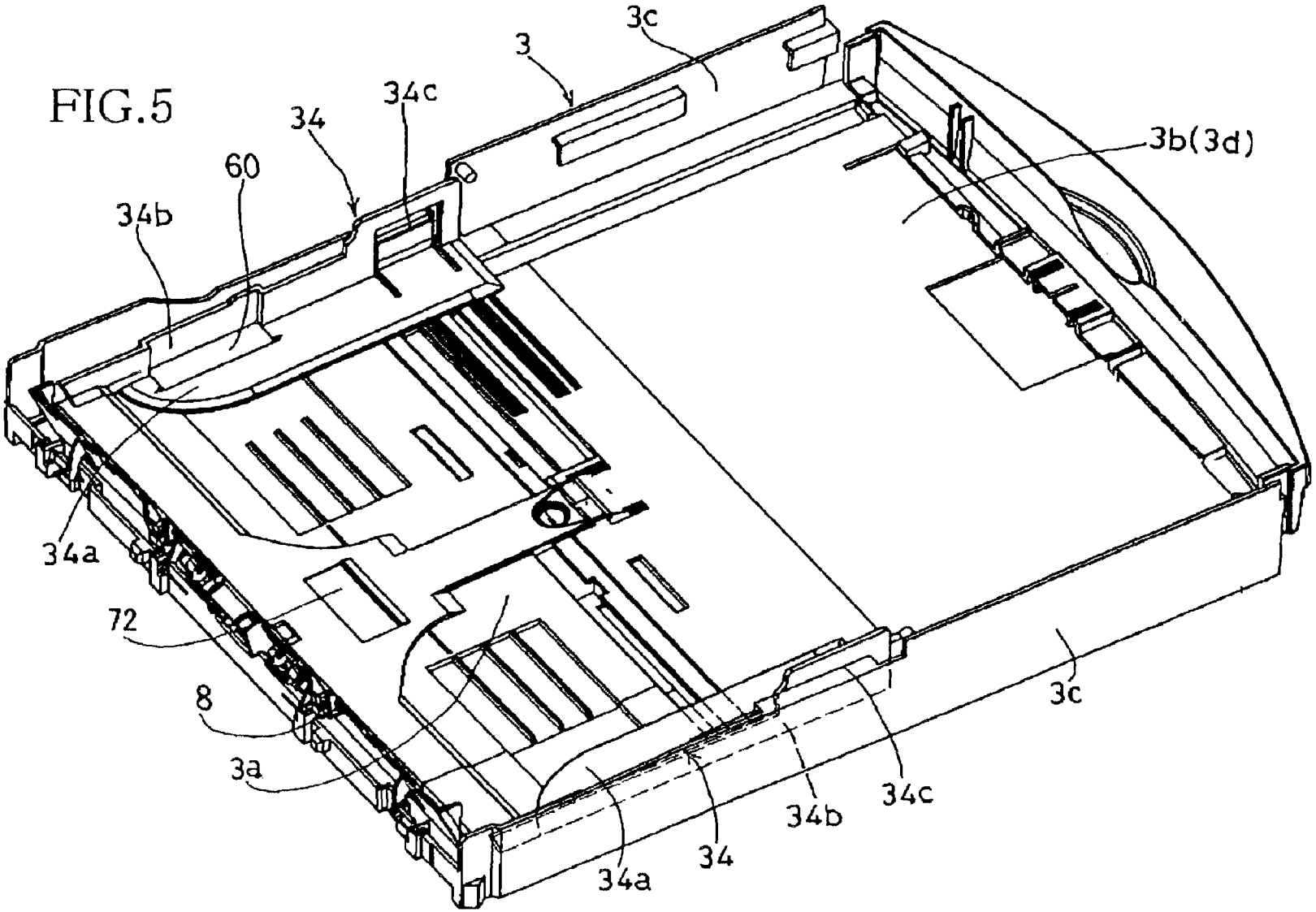
FIG. 5 is a perspective view of the first medium cassette.
Figure 6A:
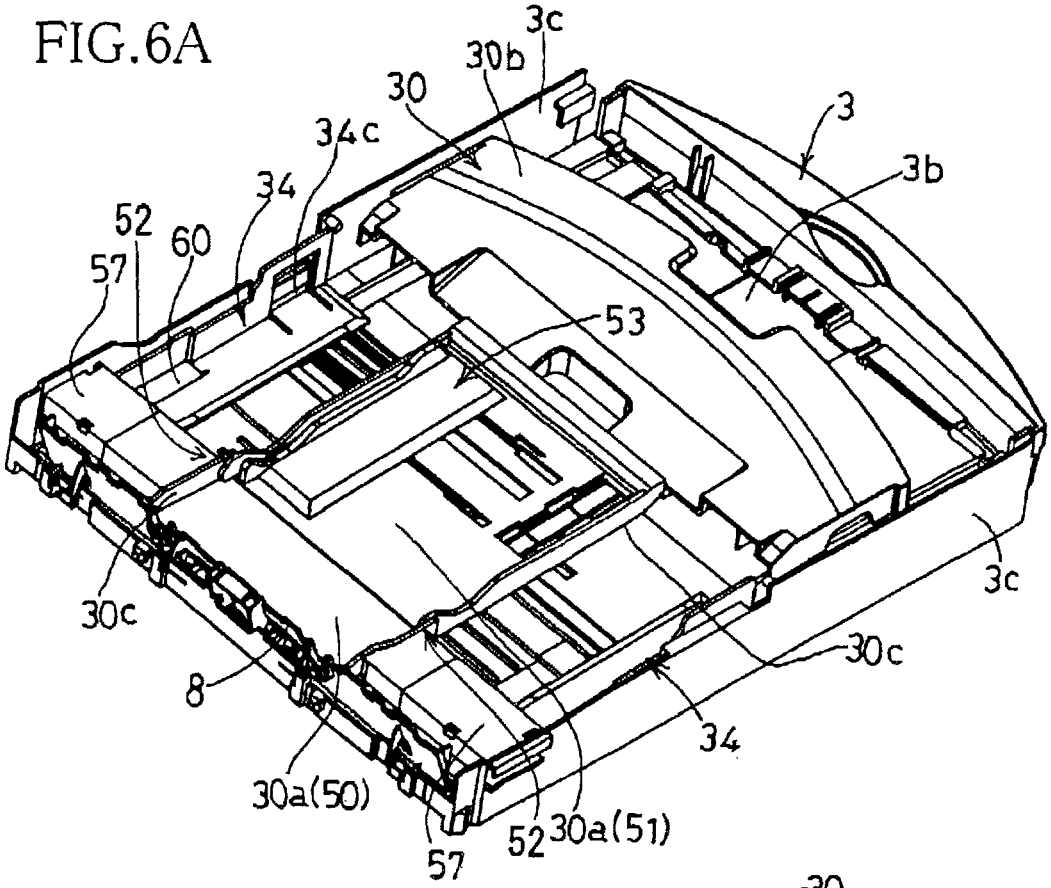
FIG. 6A is a perspective view showing a state in which the second medium cassette is located at the sheet-supply position above the first medium cassette.

The sheet-supply roller 6*b* of the sheet-supply means 6 is constructed such that the sheet-supply roller 6*b* contacts an upper surface of the uppermost one of the recording sheets P accommodated in the first support portion 3*b* of the first sheet-supply cassette 3 when the second sheet-supply cassette 30 is located at a retracted position (a non-sheet-supply position) where the second sheet-supply cassette 30 is located upstream relative to the first sheet-supply cassette 3 and such that the sheet-supply roller 6*b* contacts an upper surface of the uppermost one of the recording sheets P1 accommodated in the second sheet-supply cassette 30 when the second sheet-supply cassette 30 is located at an advanced position (a sheet-supply position) where the second sheet-supply cassette 30 is located downstream relative to the first sheet-supply cassette 3. In FIGS. 5 through 7, the recording sheets P and P1 are not shown.

The first sheet-supply cassette 3 can accommodate a multiplicity of the cut recording sheets P as the cut sheets having a large size such as A4 size, legal size, or letter size, such that the sheets P are stacked on each other and such that respective short sides of the sheets P extend in the Y-axis direction (i.e., the direction perpendicular to the sheet plane of FIG. 2, the main scanning direction). In the present embodiment, in a case where the recording sheets P are standard sheets, a maximum of about 100 pieces of the sheets P or a maximum of about 10 mm in height of the stacked sheets P can be stacked on the first support portion 3*b* of the first sheet-supply cassette 3.

As shown in FIG. 2, there is provided a handle portion 3*f* at a front end of the first sheet-supply cassette 3, by which a user can easily hold the first sheet-supply cassette 3 when the first sheet-supply cassette 3 is inserted into or retracted from the front opening 2*a* of the housing 2.

The first sheet-supply cassette 3 may additionally include, in a recessed portion 3*d* located at a front end portion thereof (corresponding to the front side of the housing 2), an auxiliary support member for supporting respective rear end portions of long cut sheets P such as legal-size sheets, such that the auxiliary support member is movable in the sheet-supply direction (a sub-scanning direction, or the X-axis direction).

As shown in FIGS. 4 through 8, there is provided a pair of side guide members 34 each as a main side guide on the support portion 3*b* of the first sheet-supply cassette 3, so as to be slidably movable symmetrically toward and away from each other in a direction perpendicular to the sheet-supply direction for guiding and positioning side edges of each of the recording sheets P parallel to the sheet-supply direction.

Each of the side guide members 34 comprises a bottom plate (or bottom portion) 34*a* which is substantially parallel to a bottom portion (or bottom plate) 3*a* (shown in FIGS. 2 and 5) and a side plate 34*b* which stands upright from the bottom plate 34*a* for guiding a side edge of each of the sheets P. Each side guide member 34 has a generally L-shaped cross section. The side guide member 34 also includes a holding portion 34*c* by which a user can perform a widthwise adjustment of the side guide member 34. The side plates 34*b* are located near to the respective side plates 3*c* of the first sheet-supply cassette 3 (i.e., near to respective widthwise opposite side edges of the recording sheets P accommodated in the first sheet-supply cassette 3. In addition, a sub-side guide 60 is attached to the bottom plate 34*a* of each side guide member 34 at a portion thereof which is located inside of the side plate 34*b* in the widthwise direction so as to be pivotable about a pivot axis between the standing position and the lying position Constructions of the sub-side guide 60 will be described in detail later.

In the present embodiment, there are further provided a rack member which is attached to the bottom portion of each of the side guide members 34 and a gear (not shown) which meshes with the rack member and which is located at a centerline in the widthwise direction of the bottom portion 3*a* of the first sheet-supply cassette 3 for aligning a centerline of the recording sheets P in the widthwise direction with the centerline of the first sheet-supply cassette 3 in the widthwise direction (in a direction perpendicular to the sheet-supply direction), or for so-called "center-positioning".

The first sheet-supply cassette 3 has, in a rear end portion thereof (i.e., a right-hand end portion in FIG. 2, or a downstream end portion in the sheet-supply direction), a main inclined sheet-separate plate 8 which separates each one cut sheet P from the other cut sheets P. The sheet-supply roller 6*b* is supported by a lower end portion of the sheet-supply arm 6*a*, and as shown in FIG. 2, an elastic separate pad 8*a* as a sheet-separate means is provided on an inner surface (a front surface) nearer to a middle portion of the main inclined sheet-separate plate 8 in the widthwise direction (in the Y-axis direction). In the present embodiment, the elastic separate pad 8*a* consists of a leaf spring made of a metal. The sheet-supply roller 6*b* and the elastic separate pad 8*a* cooperate with each other to separate and supply, one by one, the cut sheets P stacked on each other in the first sheet-supply cassette 3. The separated sheet P is supplied to the recording portion 7 provided at a position higher than the first sheet-supply cassette 3 via a U-turn path (i.e., a sheet-convey (sheet-feed) path) 9. Then, the sheet P on which an image has been recorded at the recording portion 7 is discharged with its recorded surface facing upward, to the sheet discharging portion 10 in communication with the opening 2*a*.

The main inclined sheet-separate plate 8 has a convexly curved shape in its plan view in which a middle portion of the plate 8 in the widthwise direction of the sheet P, i.e., the Y-axis direction, swells toward a leading end of the sheet P being supplied. On the middle portion of the sheet-separate plate 8, there is provided the serrate elastic sheet-separate pad 8*a* which engages the leading end of each cut sheet P to promote separation of the each cut sheet P from the other cut sheets P. Thus, the middle portion of the front surface of the main inclined sheet-separate plate 8 in the widthwise direction of each cut sheet P projects such that the middle portion of the front surface contacts the leading end of the cut sheet P being supplied, prior to the opposite end portions of the front surface, and the opposite end portions subsequently contact the leading end. Thus, the elastic sheet-separate pad 8*a* which is located in the widthwise middle portion of the plate 8 can surely separate the cut sheets P, one by one. In addition, there is provided free-rotating rollers (not shown) attached on both sides of the elastic sheet-separate pad 8*a* in the widthwise direction, near an upper end of the main inclined sheet-separate plate 8, so as to introduce (guide) the each cut sheet P smoothly toward the U-turn path 9. The main inclined sheet-separate plate 8 is formed independently of the first sheet-supply cassette 3 so as to be removably attached to a rear end of the cassette 3.

Figure 8:
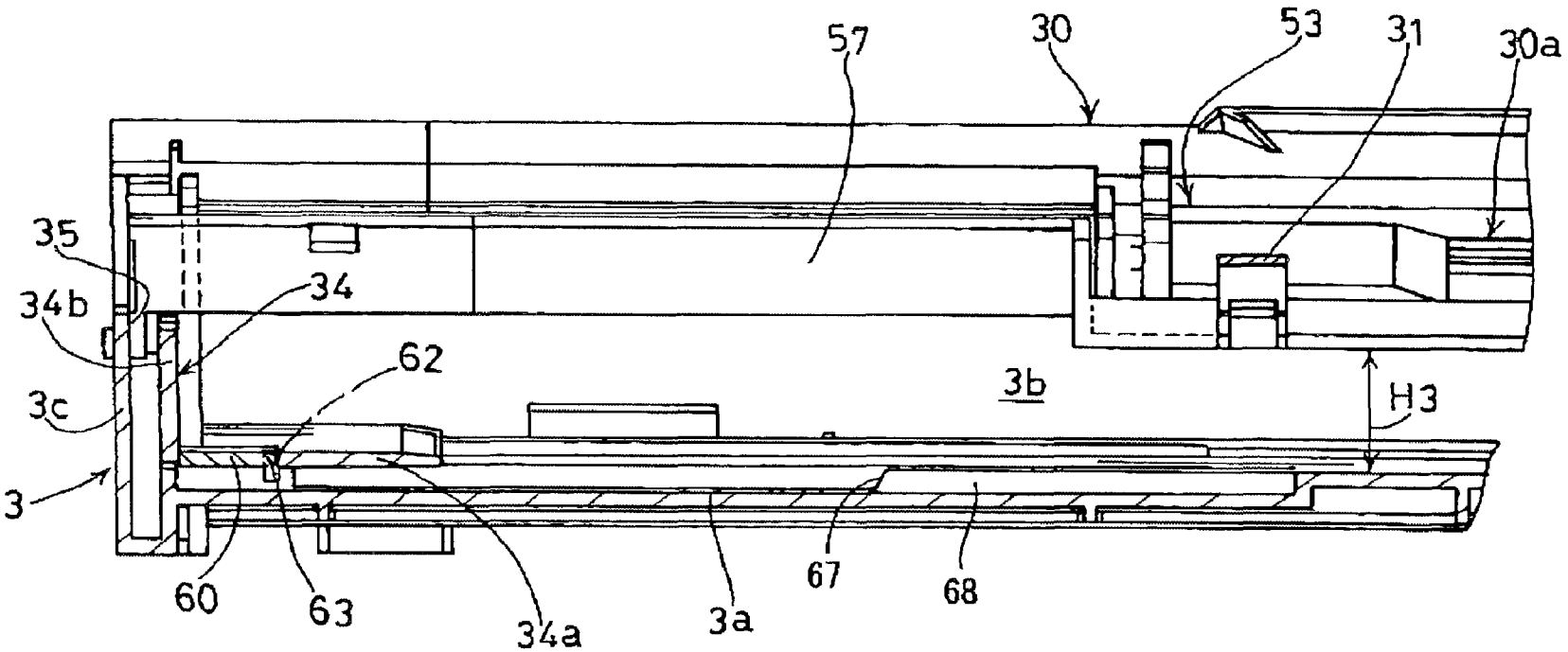
FIG. 8 is an enlarged, cross-section view taken along line 8-8 in FIG. 4.

The second sheet-supply cassette 30 is movable relative to the first sheet-supply cassette 3 between the advanced, sheet-supply position and the retracted, non-sheet-supply position. There is provided a stopper mechanism so as to stop a movement of the second sheet-supply cassette 30 relative to the first sheet-supply cassette 3 when the second sheet-supply cassette 30 is located in the advanced, sheet-supply position. As shown in FIGS. 4, 6A, and 8, the second sheet-supply cassette 30 has two engaging portions 31 such as engaging claws extending upward and projecting frontward at a leading end of a bottom plate constituted as the second support portion 30*a* of the second sheet-supply cassette 30 (on a downstream side in the sheet-supply direction). As shown in FIG. 4, the main inclined separate plate 8 in the first sheet-supply cassette 3 is formed with two engaging grooves 8*b*. When the second sheet-supply cassette 30 is pushed to the advanced, sheet-supply position, the engaging portions 31 engage the respective engaging grooves 8*b*, thereby preventing the second sheet-supply cassette 30 from moving in the X-axis direction. A recessed portion at a lower surface of the engaging portion 31 engages a lower edge of the engaging groove 8*b* so as to maintain a state in which the second sheet-supply cassette 30 is moved to the advanced, sheet-supply position (not shown). The two pairs of engaging portions 31 and engaging grooves 8*b* are arranged so as to be spaced apart from each other by an appropriate distance in the lengthwise direction of the main inclined separate plate 8, or in the widthwise direction of the sheets P1, and are provided on both sides of the elastic sheet-separate pad 8*a*. Thus, when the second sheet-supply cassette 30 is set in the sheet-supply position relative to the first sheet-supply cassette 3, the stopper mechanism can effectively prevent the second sheet-supply cassette 30 from being instable at the set position (the sheet-supply position), that is, prevents the same 30 from moving upward and downward, moving in the widthwise direction of the sheets P1, and tilting upward or downward. The stopper mechanism described above is easily disengaged when the second sheet-supply cassette 30 is retracted to the non-sheet-supply position.

Figure 6B:
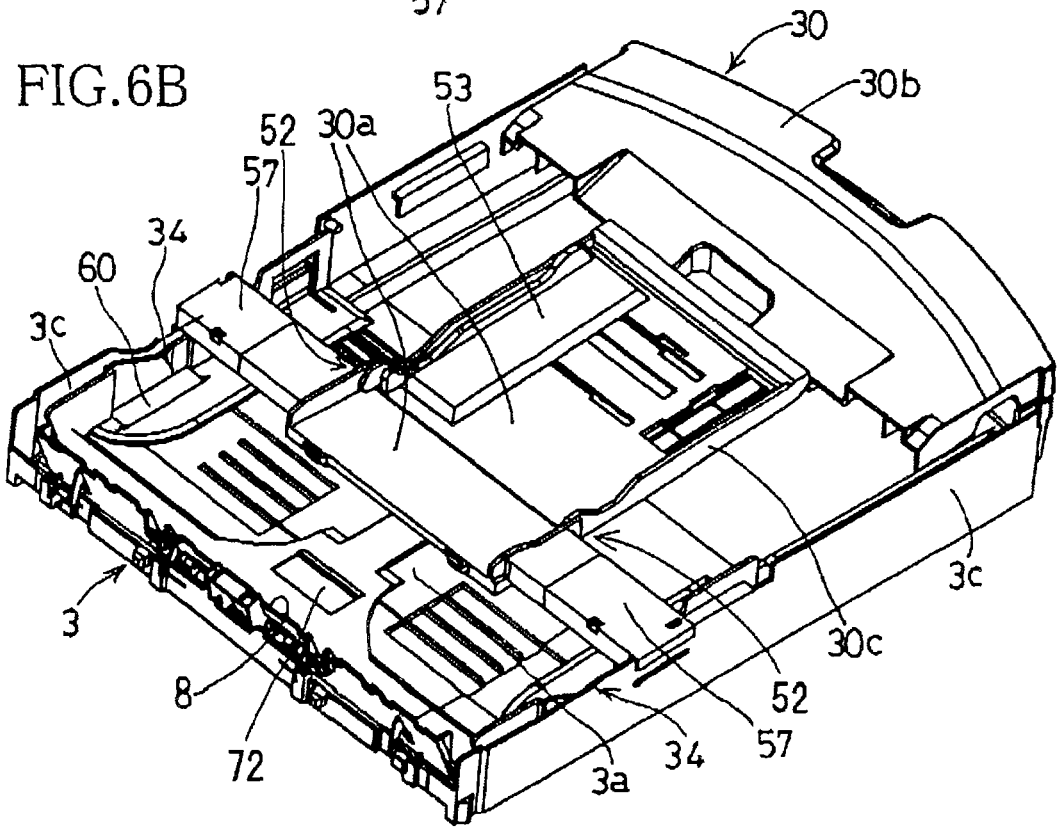
FIG. 6B is a perspective view showing a state in which the second medium cassette is located at a non-sheet-supply position above the first medium cassette.
Figure 7:
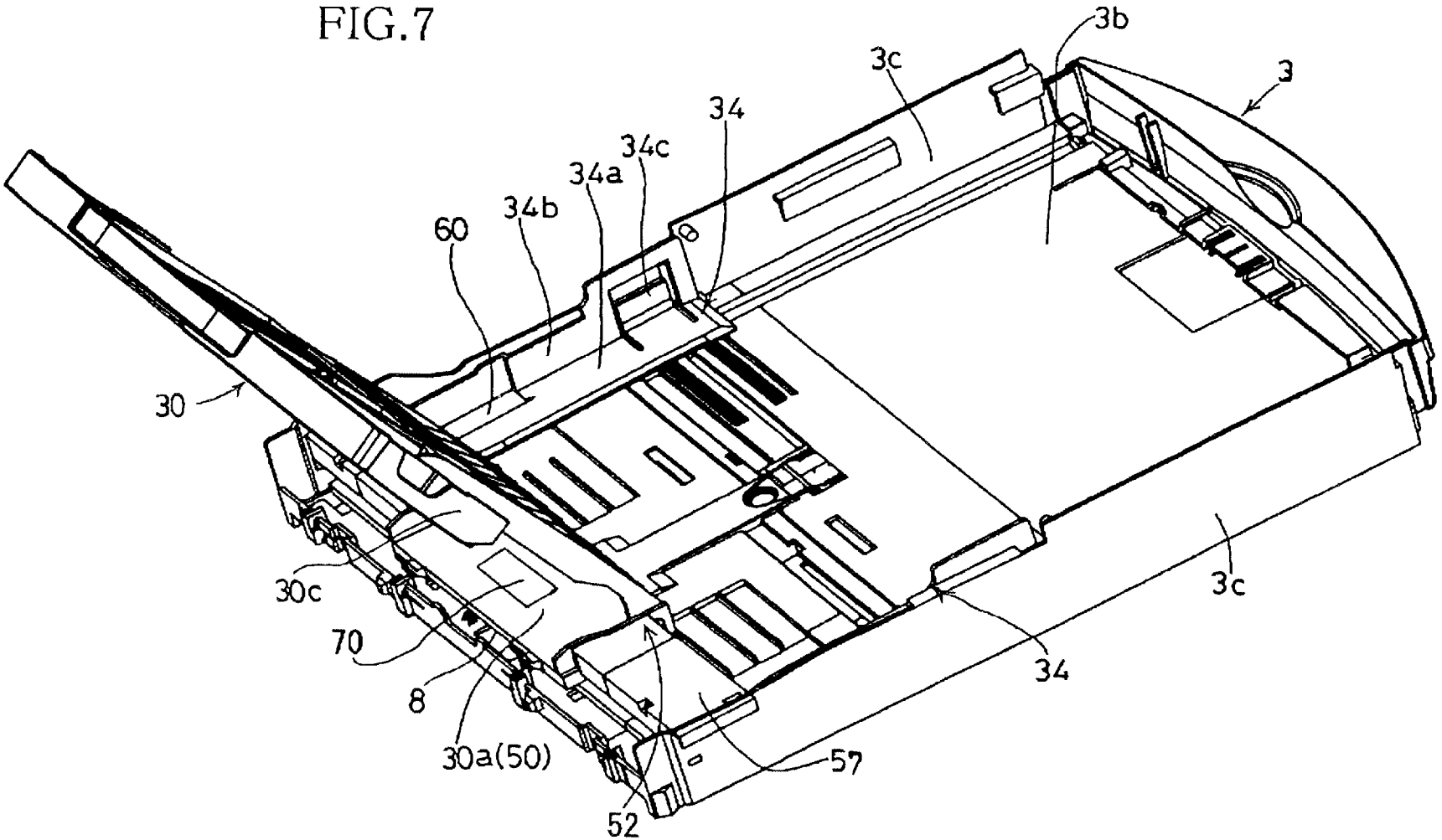
FIG. 7 is a perspective view showing a state in which the second medium cassette is located at the sheet-supply position and a pivotable portion of a second support portion of the second medium cassette is pivoted upward.

The second sheet-supply cassette 30, shown in FIGS. 4, 6A and 6B, includes the second support portion (bottom plate) 30*a* and two side plates 30*c* provided at opposite sides of the second support portion 30*a* extending in the sheet-supply direction. The second support portion 30*a* is formed integrally with the side plates 30*c*. The second support portion 30*a* can support a multiplicity of the cut recording sheets P1 such that the sheets P1 are stacked on each other. The recording sheets P1 have a smaller size (such as postcard size or photograph-L size) than the size of the recording sheets P accommodated in the first sheet-supply cassette 3. The recording sheets P1 may be of different sorts such as sheets for exclusive use with ink jet printers and glossy sheets for photographs. A guide means 53 provided on the second support portion 30*a* (in the present embodiment, functioning also as a pivotable portion 51 described later) positions the recording sheets P1 stacked on the second support portion 30*a* so as to extend parallel to the sheet-supply direction. In the present embodiment, a single guide means 53 is provided at a portion of the second support portion 30*a* nearer to one side plate 30*c* so as to move toward and away relative to the other side plate 30*c*. Thus, a reference position for an image recording with respect to the sheets P1 is along the other side plate 30*c* (performing so-called "one-side positioning").

As shown in FIGS. 6A and 6B, the second support portion 30*a* includes: a non-pivotable portion 50 which is attached to the first sheet-supply cassette 3, which is not pivotable when the sheets P are supplied to the first sheet-supply cassette 3 and which receives a pressure from the sheet-supply roller 6*b* when the sheet-supply roller 6*b* contacts the sheet P1 accommodated in the second sheet-supply cassette 30; and a pivotable portion 51 which is pivotable when the sheets P are supplied to the first sheet-supply cassette 3. The pivotable portion 51 is pivotable, about a pivot axis extending in the widthwise direction, between a position where at least a part of a space above the first support portion 3*b* is exposed or opened and a position where said at least a part of a space is covered. The pivotable portion 51 is connected to the non-pivotable portion 50 (in the present embodiment, the side plates 30*c*) via hinge portions 52 including shaft portions (not shown) which extend in the direction perpendicular to the sheet-supply direction (in the widthwise direction). The pivotable portion 51 is pivotable such that an upstream portion in the sheet-supply direction of the space above the first support portion 3*b* is exposed more widely than a downstream portion thereof When the pivotable portion 51 is located at the position covering the first support portion 3*b*, the recording sheets P1 are supported on the second support portion 30*a* lying across the non-pivotable portion 50 and the pivotable portion 51. When the pivotable portion 51 is located at the position exposing the space above the first support portion 3*b*, the recording sheets P1 are supported on and lifted up by the pivotable portion 51, apart from the non-pivotable portion 50 (shown in FIG. 7).

The pivotable portion 51 is connected to an upstream portion of the non-pivotable portion 50 in the sheet-supply direction via the hinge portions 52 which are disposed at a downstream portion of the second support portion 30*a* and at a downstream end portion of the pivotable portion 51 in the sheet-supply direction. The hinge portions 52 may be disposed at a downstream portion of the non-pivotable portion 50. There is provided a discharged-sheet receiving portion 30*b* which is connected integrally to the pivotable portion 51 adjacent to an upstream end portion thereof in the sheet-supply direction. The discharged-sheet receiving portion 30*b* has a large width equal to the width of the first sheet-supply cassette 3. In other words, the second support portion 30*a* has a width as measured in the widthwise direction that is made smaller at the downstream portion than at the upstream portion thereof Therefore, when an image is recorded on the sheets P stacked in the first sheet-supply cassette 3 and having a large size, the recorded sheets P are surely and entirely received on a front portion (the upstream portion) of the second sheet-supply cassette 30 (i.e., the discharged-sheet receiving portion 30*b*) located at the retracted, non-sheet-supply position.

As shown in FIGS. 4, 6A and 6B, there are provided two wing portions 57 so as to integrally protrude from downstream portions of the respective side plates 30*c* toward opposite side plates 3*c* of the first sheet-supply cassette 3. The wing portions 57 are arranged to be slidable on a pair of rail portions 35 (shown in FIGS. 8, 10A and 10B) provided on the respective side plates 3*c* of the first sheet-supply cassette 3. Since the wing portions 57 have respective stoppers (not shown) which prevent the same 57 from being detached from the corresponding rail portions 35, the second sheet-supply cassette 30 is not easily detached from the first sheet-supply cassette 3.

As shown in FIG. 2, there is provided a handle portion 30*d* at an upstream end portion of the second sheet-supply cassette 30 in the sheet-supply direction, i.e., at an end portion of the discharged-sheet receiving portion 30*b*, by which a user can easily hold the second sheet-supply cassette 30, by holding the handle portion 30*d* with a hand, the user can easily slide the second sheet-supply cassette 30 relative to the first sheet-supply cassette 3, to push (advance) the second sheet-supply cassette 30 and to draw (retract) the second sheet-supply cassette 30, relative to the first sheet-supply cassette 3. Each rail portion 35 has a large-height portion (not shown) functioning as a stopper and provided at its upstream end portion, for preventing the second sheet-supply cassette 30 from being retracted beyond the retracted position and then detached from the first sheet-supply cassette 3 and for permitting a user to detect the second sheet-supply cassette 30 reaching the retracted, non-sheet-supply position.

As shown in FIG. 4, a front half portion (a portion near to a downstream end in the sheet-supply direction) of the pivotable portion 51 of the second support portion 30*a* has a width smaller than that of the first sheet-supply cassette 3 and is disposed at a widthwise middle portion of the first sheet-supply cassette 3, whereby the holding portion 34*c* of each side guide member 34 of the first sheet-supply cassette 3 is exposed without being covered by the second sheet-supply cassette 30. Therefore, the arrangement assures the user of easy access to the side guide member 34 without a need of removing the second sheet-supply cassette 30, facilitating widthwise positioning of the sheets P stored in the first sheet-supply cassette 3.

The second support portion 30*a* of the second sheet-supply cassette 30 is arranged to be opposed in the sheet-supply direction to a portion including the elastic sheet-separate pad 8*a* of the main inclined sheet-separate plate 8. Thus, one sheet-supply roller 6*b* and one inclined sheet-separate plate 8 are commonly used for a separation and a supply of the sheets P and the sheets P1 stored in the first sheet-supply cassette 3 and the second sheet-supply cassette 30, respectively.

Figure 9:
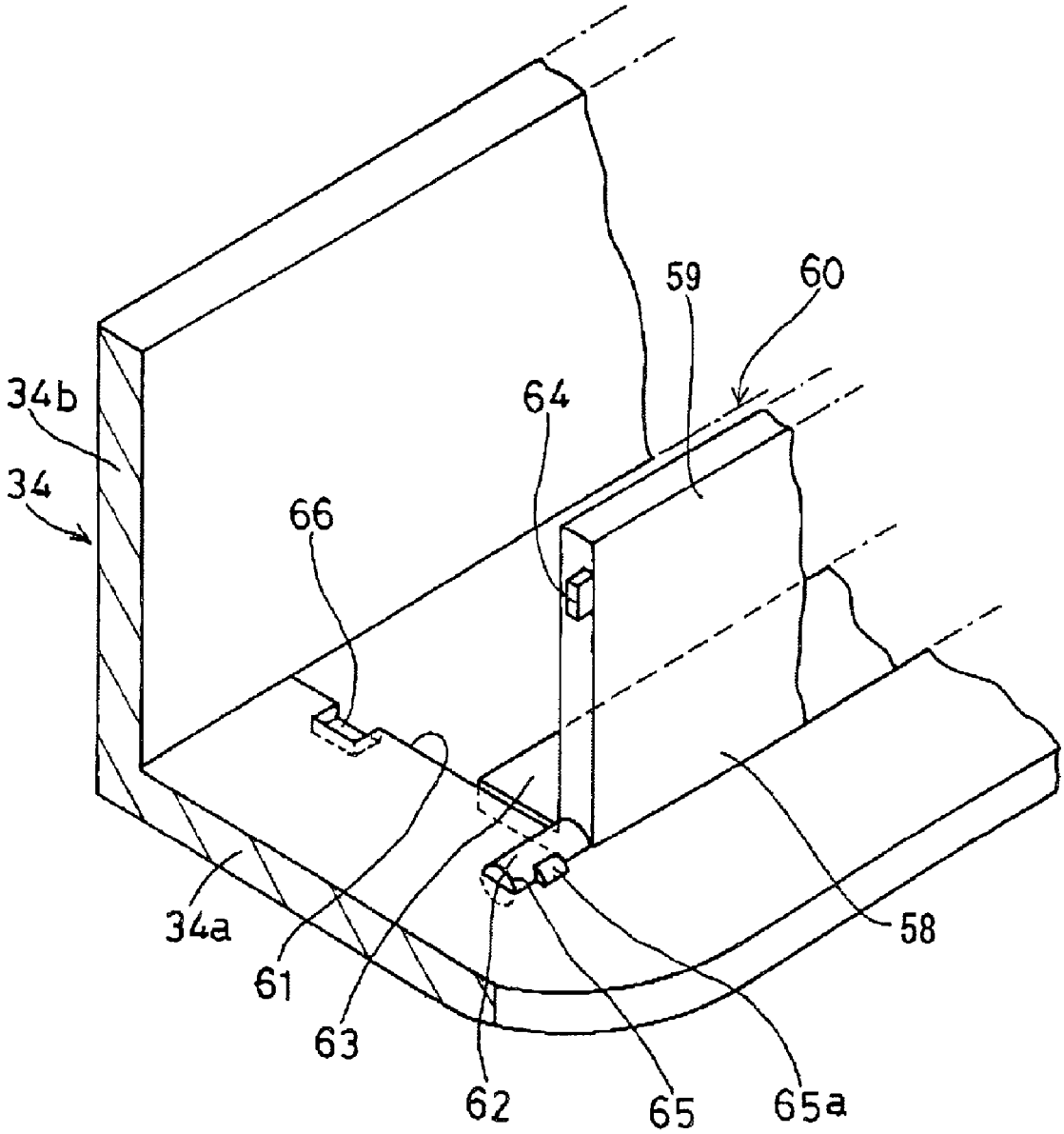
FIG. 9 is a partly cut-away perspective view showing a sub-side guide provided on a main side guide.

Next, there will be described in detail constructions of the sub-side guide 60. As shown in FIGS. 8 through 10, each sub-side guide 60 includes a base portion 58 extending along the pivot axis which extends parallel to the sheet-supply direction; a guide plate portion 59 extending from the base portion 58 in a direction perpendicular to the pivot axis; and a driven portion 63 extending from the base portion 58 in a direction perpendicular to the guide plate portion 59. The driven portion 63 is arranged to be parallel to the bottom plate 34*a* of the side guide member 34 in a state in which the guide plate portion 59 is in the standing position and to extend perpendicularly to the bottom plate 34*a* on one side of the bottom plate 34*a* opposite to the side plate 34*b* in a state in which the guide plate portion 59 is in the lying position. The sub-side guide 60 located in the standing position is parallel with the side plate 34*b* of the side guide member 34. The sub-side guide 60 includes (horizontal) shaft portions 62 which protrude from respective opposite end portions of the base portion 58 thereof (at front and rear ends in the sheet-supply direction) along the pivot axis (extending in the sheet-supply direction) and which are formed integrally with the same 60. The driven portion 63 is formed integrally with the base portion 58 of the sub-side guide 60. The driven portion 63 is driven for raising the sub-side guide 60 and is described in detail later.

As shown in FIG. 9, the opening 61 is formed in the bottom plate 34*c* of each side guide member 34 so that the sub-side guide 60 is accommodated in the opening 61 with the guide plate portion 59 lying horizontally. At opposite ends of the opening 61 in the sheet-supply direction, there are formed recessed portions 65 by which the respective shaft portions 62 are rotatably supported. On widthwise edges of the recessed portions 65, projections 65*a* are integrally formed to project upward from the upper surface of the bottom plate 34*a*, for preventing the shaft portions 62 from coming off the recessed portions 65. In FIG. 9, one projection 65*a* is provided for each recessed portion 65. However, two projections 65*a* may be provided for each recessed portion 65 on the widthwise opposite edges thereof Further, the positional relationship between the opening 61 and the sub-side guide 60, the dimension of the opening 61, and the dimension of the sub-side guide 60 are preferably determined such that, when the sub-side guide 60 pivots from the lying position to the standing position, the sub-side guide 60 is prevented from pivoting beyond the standing position due to the inertia, by contact thereof with the periphery of the opening 61.

As shown in FIG. 9, there is provided an engaging recessed portion 66 as a first engaging portion on an upper surface of the bottom plate 34*c* and on a periphery of the opening 61, which is arranged to engage an engaging portion 64 as a second engaging portion to limit the pivotal movement of the sub-side guide 60 in a direction from the standing position to the lying position. Thus, when the sub-side guide 60 is laid down horizontally so as to be flush with the upper surface of the bottom plate 34*a*, the engaging portion 64 engages the engaging recessed portion 66 and prevents the sub-side guide 60 from being laid down furthermore. Also, in a state where the sub-side guide 60 is at the lying position, the recording sheets P (especially widthwise side portions thereof) are stacked evenly on the upper surface (a support surface) of the bottom plate 34*c*.

Figure 10A:
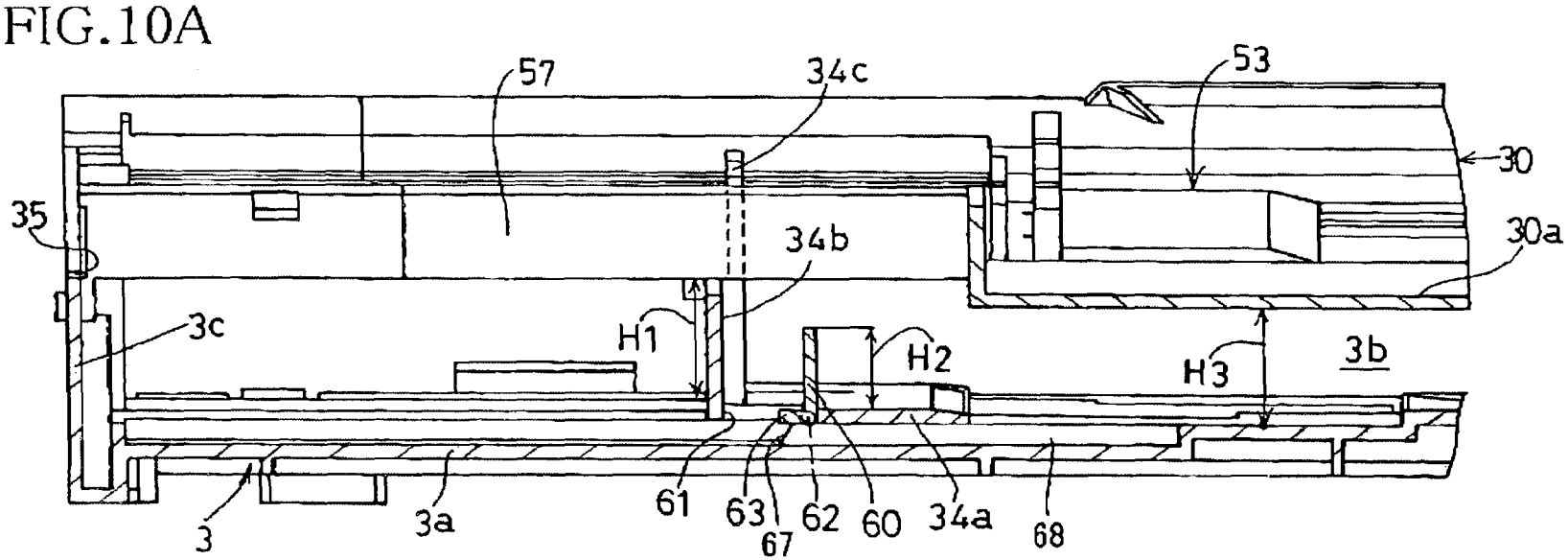
FIG. 10A is a partly cut-away, enlarged, cross-sectional view showing the sub-side guide in a standing position supported on a parallel portion.
Figure 10B:
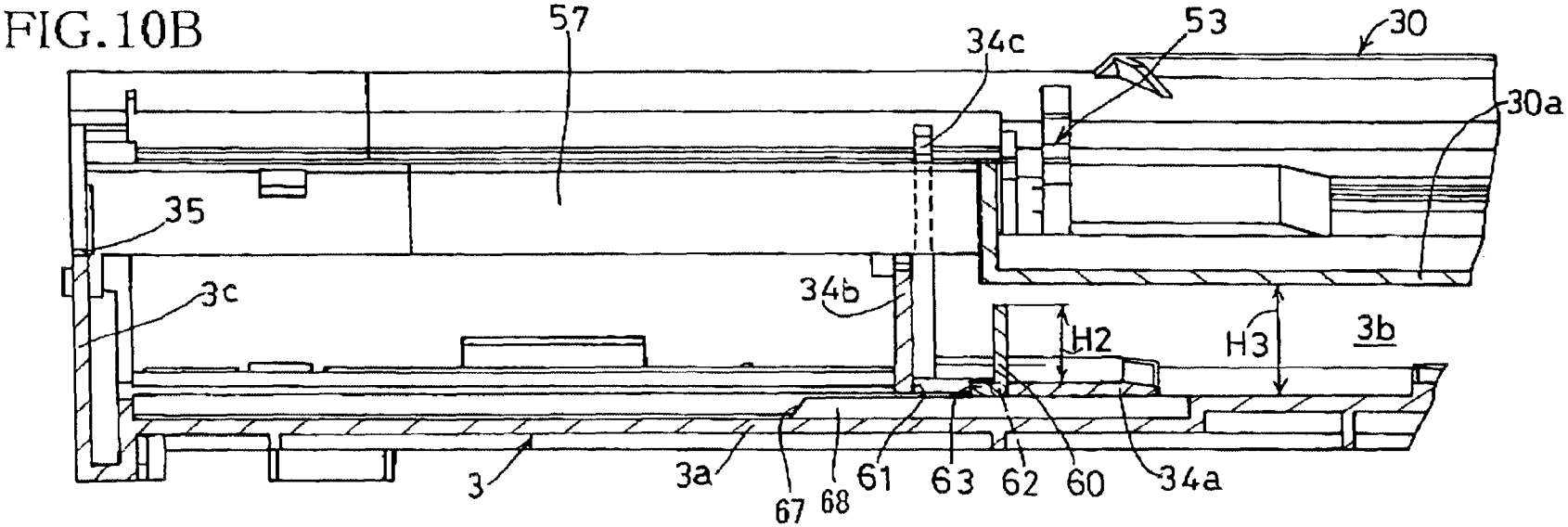
FIG. 10B is a partly cut-away, enlarged, cross-sectional view showing the sub-side guide located beneath a second support portion of the second medium cassette.

As shown in FIGS. 8, 10A and 10B, a height (H1) of the side plate 34*b* of the side guide member 34 is determined such that a top end thereof is positioned higher than a height position of the second support portion 30*a* of the second sheet-supply cassette 30, while a height (H2) of the sub-side guide 60 is made shorter than a distance (H3) from a bottom surface (a support surface) of the first support portion 3*b* of the first sheet-supply cassette 3 to a lower surface of the second support portion 30*a* of the second sheet-supply cassette 30. That is, the sub-side guide 60 has a height that allows itself to be located beneath the second support portion 30*a* in a state in which the sub-side guide 60 is at the standing position. Accordingly, when a pair of the sub-side guides 60 move symmetrically toward each other in the widthwise direction (as indicated by two-dot chain line in FIG. 4), that is, the sheets P having a small width such as a Monarch size (98.4 mm×190.5 mm) of sheets are stacked on the first support portion 3*b* of the first sheet-supply cassette 3, the sub-side guides 60 can move into a space beneath the second support portion 30*a*, and thus each side surface (inner surface) of the sub-side guides 60 in the standing position can contact and guide each of widthwise side edges of the sheets P having a small size as described above. Therefore, the sheets P having a smaller width than that of the sheets P1 which can be stacked on the second support portion 30*a* of the second sheet-supply cassette 30 can be stacked on the first support portion 3*b* of the first sheet-supply cassette 3 for an image recording without removing the second sheet-supply cassette 30 from the first sheet-supply cassette 3, resulting in a diversification of sizes of the recording sheets on which the image recording apparatus can record an image. Also, the sheets P having a small size can be guided in a center-positioned way by a pair of the sub-side guides for image recording, while the one-side positioning is performed so that the sheets P1 are guided by the guide means 53 and one of the side plate 30*c*.

As shown in FIGS. 8; 10A and 10B, each sub-side guide 60 includes the driven portion 63 provided on the base portion 58 to pivot the same 60 toward the standing position. On the other hand, the first sheet-supply cassette 3 also includes for each of the sub-side guide 60 an inclined portion 67 and a parallel portion 68 each of which is provided on the bottom portion 3*a* thereof. The inclined portion 67 engages the driven portion 63 so as to pivot the sub-side guide 60 from the lying position to the standing position when the side guide member 34 is moved toward a widthwise middle portion of the first support portion 3*b*. The inclined portion 67 has an inclined surface and is inclined with respect to the widthwise direction such that a height thereof decreases toward the side guide member 34 in the widthwise direction. In the present embodiment, the inclined surface of the inclined portion 67 is linearly inclined. The inclined portion 67 may be curvedly inclined or convexly curved. The parallel portion 68 extends in the widthwise direction and maintains the sub-side guide 60 in the standing position. When the side guide member 34 is moved away from the widthwise middle portion of the first support portion 3*b* (toward the side plate 3*c* of the first sheet-supply cassette 3), the driven portion 63 engages the inclined portion 67 so that the sub-side guide 60 automatically pivots toward the lying position because of its own weight to be accommodated in the opening 61. As described above, the user moves the side guide member 34 toward the widthwise middle portion of the first support portion 3*b* so as to automatically raise or stand the sub-side guide 60. Therefore, it is not necessary for the user to raise the sub-side guide 60 when the sheets P having a small size in the widthwise direction are set on the first support portion 3*b*. Also, since the sub-side guide 60 is pivoted to the lying position that is parallel with the bottom plate 34*a* of the side guide member 34 when the user moves the side guide member 34 away from the widthwise middle portion of the first support portion 3*b*, the sheets P having a large size in the widthwise direction are easily set on the first support portion 3*b*.

In the present embodiment, in order to align the centerline of the recording sheets P in the widthwise direction with the centerline of the first sheet-supply cassette 3 in the widthwise direction, or for so-called "center-positioning", the two side guide members 34 each as the main side guide are provided so as to move symmetrically toward and away from each other in the widthwise direction of the first support portion 3*b*, and the sub-side guide 60 is provided for each of the two side guide members 34. Therefore, both the small size sheets P and the large size sheets P are center-positioned by each pair of the side guide members 34 and the sub-side guides 60 for an image recording. In a modified form of the present embodiment, where the recording sheets P are supplied with one side edge thereof contacting one of the two side plates 3*c* of the first sheet-supply cassette 3, one side guide member 43 may be provided on a portion of the first sheet-supply cassette 3 nearer to the other side plate 3*c* so as to be slidably movable in the widthwise direction. Further, one sub-side guide 60 may be provided on the bottom plate 43*a* of the side guide member 43 so as to be pivotable between the standing position and the lying position.

In the illustrated embodiment, the first and the second sheet-supply cassettes 3 and 30 are housed in the housing 2 in a state that a multiplicity of the recording sheets P are stacked on each other on the first support portion 3*b* of the first sheet-supply cassette 3 and a multiplicity of the recording sheets P1 are stacked on each other on the second support portion 30*a* of the second sheet-supply cassette 30. In a state in which the first and second sheet-supply cassettes 3 and 30 are housed in the housing 2, when the second sheet-supply cassette 30 is pushed to the sheet-supply position (a position where the second sheet-supply cassette 30 is close to a rear end portion of the first sheet-supply cassette 3), the uppermost one of the sheets P1 on the second sheet-supply cassette 30 is pressured and supplied to the recording portion 7 by the sheet-supply roller 6*b* and then an image is recorded on it. On the other hand, when the second sheet-supply cassette 30 is retracted to the non-sheet-supply position, the uppermost one of the sheets P on the first sheet-supply cassette 3 is pressured and supplied to the recording portion 7 by the sheet-supply roller 6*b* and then an image is recorded on it. The sheets P and P1 on which an image is to be recorded, are easily changed without removing either of the cassettes 3, 30 from the housing 2.

In the illustrated embodiment, the second sheet-supply cassette 30 is attached undetachably to the first sheet-supply cassette 3 and is movable in the sheet-supply direction relative to the first sheet-supply cassette 3. Therefore, the second sheet-supply cassette 30 can be easily positioned in place relative to the first sheet-supply cassette 3. Also, since the second sheet-supply cassette 30 is attached to the first sheet-supply cassette 3, it is not needed to prepare a storage space for storing the second sheet-supply cassette 30 while not in use, eliminating a risk that the second sheet-supply cassette 30 becomes lost.

In addition, the cut recording sheets P having a smaller width than that of the cut recording sheets P1 stacked on the second support portion 30*a* of the second sheet-supply cassette 30 can be stacked on the first support portion 3*b* of the first sheet-supply cassette 3 for an image recording, without removing the second sheet-supply cassette 30 from the first sheet-supply cassette 3. Further, the recording sheets with various sizes can be used for image recording performed by the image recording apparatus 1.

Prior to the present invention, the applicant has proposed in JP-A-2005-286389 a sheet-supply apparatus which has a stacked structure consisting of two sheet-supply cassettes (a first sheet-supply cassette and a second sheet-supply cassette). In the sheet-supply apparatus, the second sheet-supply cassette disposed above the first sheet-supply cassette is movable toward and away in a sheet-supply direction relative to the first sheet-supply cassette. Therefore, when a use of the first sheet-supply cassette and a use of the second sheet-supply cassette are repeatedly changed, sheets accommodated in the first sheet-supply cassette can be supplied in a state in which the second sheet-supply cassette accommodating sheets is set on the first sheet-supply cassette, without removing the second sheet-supply cassette from the first sheet-supply cassette.

In the sheet-supply apparatus described above, when the size of the sheets stacked on the first sheet-supply cassette is changed to another, a guide member which guides a side edge of each of the sheets in a widthwise direction is movable in the widthwise direction of the sheets without removing the second sheet-supply cassette, so that different sizes of the sheets can be easily guided by the guide member However, in a case where the sheets stacked on the first sheet-supply cassette have a size equal to or smaller than a size of the sheets stacked on the second sheet-supply cassette, the guide member of the first sheet-supply cassette may contact a side portion of the second sheet-supply cassette during the widthwise movement of the guide member and the guide member cannot guide the sheets.

The illustrated embodiment is free of the above-indicated problem and provides a simple structure which enables accommodation and supplying of different sizes of the sheets P, P1. Also, the sub-side guide 60 is provided on the side guide member 43 so as to be pivotable between the standing position and the lying position. Accordingly, in a case where there is a limit in a range of the widthwise sliding movement of the side guide member 43, the sheets P having different sizes in the widthwise direction can be easily supplied to the first sheet-supply cassette 3, assuring a high reliability of the sheet-supply operation.

For supplying the sheets P to the first sheet-supply cassette 3, the first sheet-supply cassette 3 is pulled out of the housing 2 along with the second sheet-supply cassette 30. In each case where the second sheet-supply cassette 30 is in the advanced, sheet-supply position (shown in FIG. 6A) and in the retracted, non-sheet-supply position (shown in FIG. 6B), the pivotable portion 51 can be pivotable such that its upstream end portion in the second support portion 30*a* can be lifted up. FIG. 7 shows a state in which the second sheet-supply cassette 30 is located in the sheet-supply position and is pivoted upward. The pivotable portion 51 is so pivoted that a space above the first support portion 3*b* is widely exposed or opened. Thus, the sheets P are easily supplied to the first sheet-supply cassette 3. Especially, the pivotable portion 51 is pivotable such that an upstream portion of the space above the first support portion 3*b* in the sheet-supply direction is exposed or opened more widely than a downstream portion thereof. Accordingly, the sheets P can be easily inserted to the first sheet-supply cassette 3 from the upstream portion of the space above the first support portion 3*b* in the sheet-supply direction. In a case in which the hinge portions 52 are provided on a middle portion of the second support portion 30*a* in the sheet-supply direction, the pivotable portion 51 has a length as measured in the sheet-supply direction smaller than an overall length of the second support portion 30*a* as measured in the sheet-supply direction. In this case, compared to a pivot angle when the pivotable portion 51 consisting of a whole of the second support portion 30*a* is pivoted to a predetermined height position, a pivot angle when the pivotable portion 51 having the smaller length than the overall length of the second support portion 30*a* is pivoted to the predetermined height position is made larger, that is, a space above the first support portion 3*b* is more widely exposed, so that the sheets P are more easily supplied to the first support portion 3*b*.

On the second support portion 30*a*, in addition to the pivotable portion 51, a portion thereof receiving a pressure from the sheet-supply roller 6*b* is provided as the non-pivotable portion 50. The non-pivotable portion 50 is arranged not to be pivotable so as to be permitted to have a high rigidity to maintain a high performance of sheet-supplying without a deformation of the non-pivotable portion 50 because of the pressure from the sheet-supply roller 6*b* The second sheet-supply cassette 30 further includes the engaging portions 31 for engagement with the first sheet-supply cassette 30 to stop a movement of the second sheet-supply cassette 30 relative to the first sheet-supply cassette 3. The engaging portions 31 are provided on the downstream-side end portion of the non-pivotable portion 50. Owing to the high rigidity of the non-pivotable portion 50, the second sheet-supply cassette 30 can engage the first sheet-supply cassette 3 with high stability. On the other hand, since the pivotable portion 51 is arranged to be simply pivotable while supporting the sheets P1 thereon, the pivotable portion 51 need not to have high rigidity. Therefore, the pivotable portion 51 can be light-weighted for easy pivotal movement thereof.

Moreover, the side guide member 34 comprises the bottom plate 34*a* which is parallel to the bottom portion of the first support portion 3*b* and the side plate 34*b* which stands upright from the bottom plate 34*a* and is located near to the corresponding widthwise end portion of the first sheet-supply cassette 3. The sub-side guide 60 is connected to the bottom plate 34*a* to be pivotable between the standing position and the lying position via the shaft portions 62. In a state in which the sub-side guide 60 in the lying position is accommodated in the opening 61 formed in the bottom plate 34*a*, an upper surface of the sub-side guide 60 and the upper surface of the bottom plate 34*a* are located on a same plane, and the side guide member 34 supporting the sheets P is moved on the bottom plate 34*a* and functions as a guide of the side edge of the sheets P. Therefore, the cut recording sheets P with various sizes can be accommodated in the first sheet-supply cassette 3 for image recording, without increasing required components.

The width of the second support portion 30*a* is made smaller at its downstream portion than at its upstream portion, and the side plate 34*b* of the side guide member 34 is disposed on a side which is located outside in the widthwise direction of the downstream portion of the second support portion 30*a* having the smaller width. Accordingly, even in a state in which the second sheet-supply cassette 30 is inserted to the sheet-supply position, the side guide member 34 can be moved in the widthwise direction so as to guide the sheets P on the first support portion 3*b*.

On the second support portion 30*a*, the discharged-sheet receiving portion 30*b* is formed integrally with the pivotable portion 51 at the upstream portion thereof in the sheet-supply direction adjacent to the same 51. Therefore, it is not necessary to provide a separate discharged-sheet receiving portion, resulting in a simple and compact structure.

As shown in FIG. 7, a base pad 70 is provided on the non-pivotable portion 50 at a portion thereof with which the sheet-supply roller 6*b* is to come into contact. The base pad 70 is made of materials having a frictional coefficient higher than that of the other portions of the non-pivotable portion 50, such as a cork. In this arrangement, even in a state in which a last one of the sheets P1 is left in the second sheet-supply cassette 30, the rotation of the sheet-supply roller 6*b* can be transmitted to the sheet P1 with high reliability. Similarly, a base pad 72 may be provided on the first sheet-supply cassette 3, as shown in FIGS. 4, 6.

In the illustrated embodiment, the inclined portion 67 and the parallel portion 68 provided on the bottom portion 3*a* of the first sheet-supply cassette 3 constitute a cam as the driving portion. Also, a part of the driven portion 63 of the sub-side guide 60 constitutes a cam follower to be pressed against a cam surface of the cam because of a weight of the driven portion 63. The cam and the cam follower constitute a movement converting mechanism which converts at least a part of the widthwise sliding movement of the side guide member 34 into a pivoting movement of the sub-side guide 60 between the standing position and the lying position. The cam may be a cam having a cam rib which engages a pair of cam followers provided on the driven portion, may be a cam having a cam groove which engages a cam follower, or may be a cam having a cam surface against which a cam follower is pressed by a biasing force such as an elastic force of a spring or a gravity.

Referring to FIGS. 11 through 14, there will be described another embodiment of the present invention. In this embodiment, the same reference numerals as used in the above-described embodiment are used to identify the corresponding components, and a detailed explanation of which is not provided. As shown in FIGS. 11 through 14, there are provided a pair of side guide members 100 each as the main side guide. The two side guide members 100 are supported on a support plate 102 as the first support portion of the first sheet-supply cassette 3, being slidably movable symmetrically toward and away from each other in a direction perpendicular to the sheet-supply direction (in the widthwise direction of the first sheet-supply cassette 3). The support plate 102 includes two cutouts 104 which extend in the widthwise direction of the first sheet-supply cassette 3. The cutouts 104 extend from respective side edges of the support plate 102 toward a widthwise middle portion of the same 102 and have different positions in the sheet-supply direction.

Similarly to the above-described embodiment, each side guide member 100 includes the bottom plate 34*a*, the side plate 34*b* and the holding portion 34*c*. The present embodiment differs from the above embodiment in the following structure. The bottom plate 34*a* is located beneath the support plate 102 while the side plate 34*b* is located above the support plate 102 and the side plate 34*b* is connected to the bottom plate 34*a* via a connecting portion 34*d* which is disposed through the respective cutout 104. The connecting portion 34*d* has a width slightly smaller than that of the cutout 104 so as to be slidable inside of the cutout 104. The bottom plate 34*a* has a width larger than that of the cutout 104 so as to be slidable on lower surfaces of opposite side edge portions of the cutout 104. The holding portion 34*c* is formed as an integral part of the side plate 34*b*.

A rack member 110 is formed integrally with the bottom plate 34*a*, extending from one of opposite ends of the bottom plate 34*a* remote from the side plate 34*b* in a direction apart from the side plate 34*b*. The rack member 110 includes rack teeth 112 formed on one of side edges thereof. The bottom plate 34*a* and the rack member 110 are guided by a plurality of guide members 114 to be slidable in the widthwise direction of the first sheet-supply cassette 3. The guide members 114 are provided on a bottom surface of the support plate 102. In the present embodiment, the guide members 114 and the support plate 102 constitute a guiding device.

Each rack member 110 of the pair of the side guide members 100 includes rack teeth 112 formed on one of side edges thereof close to each other. The rack teeth 112 meshes with a pinion 116 attached rotatably on a widthwise middle portion of the bottom surface of the support plate 102. Thus, when either one of the side guide members 100 is moved in the widthwise direction, the pair of the side guide members 100 are slidably moved symmetrically toward and away from each other with respect to a centerline extending in the sheet-supply direction through a middle point of the first sheet-supply cassette 3 in the widthwise direction.

A sub-side guide 60 is provided for each of the pair of the side guide members 100, on the support plate 102. The sub-side guides 60 are located inside of the side plates 34*b* in the widthwise direction so as to be pivotable about each pivot axis between the standing position and the lying position. Each sub-side guide 60 includes the base portion 58, the guide plate portion 59, and the driven portion 63. The sub-side guide 60 also includes the shaft portions 62, the engaging portion 63 and the stopper 65*a*. The engaging portion 63 and the stopper 65*a* are not shown in FIGS. 11 through 14.

Figure 11:
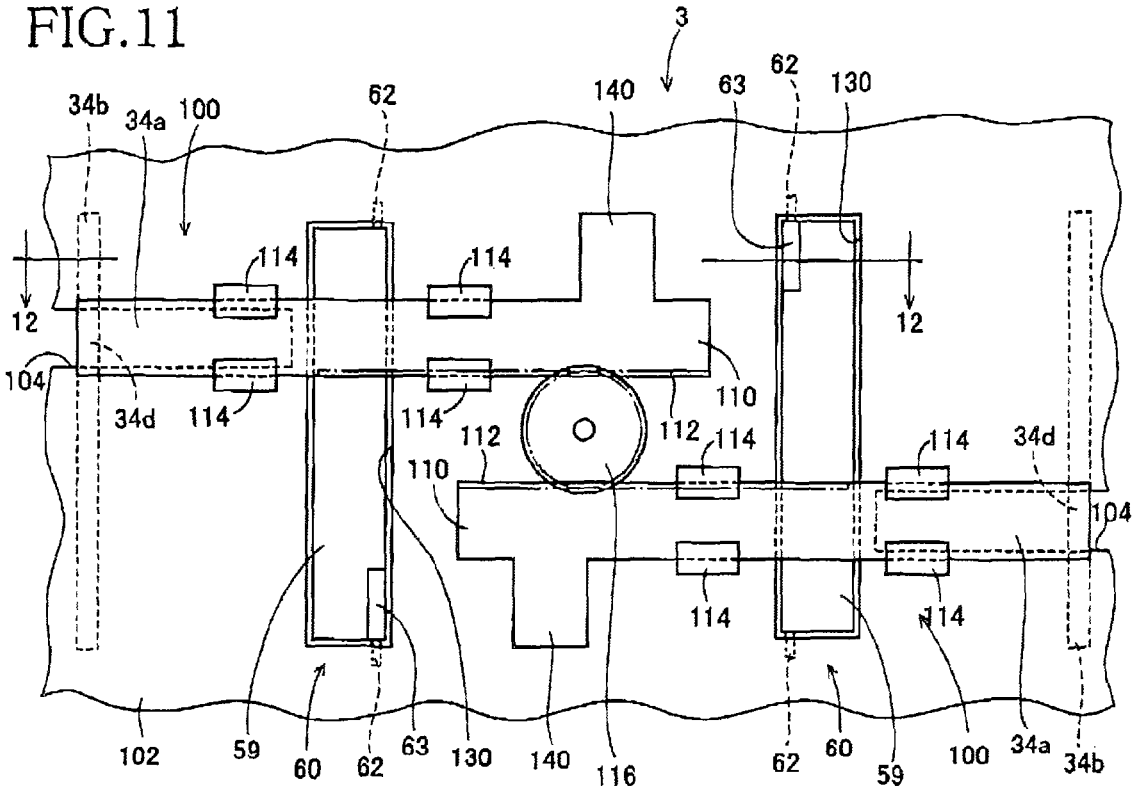
FIG. 11 is a plan view schematically showing a sub-side guide in a lying position along with a main side guide, constructed according to another embodiment of the invention.
Figure 12:
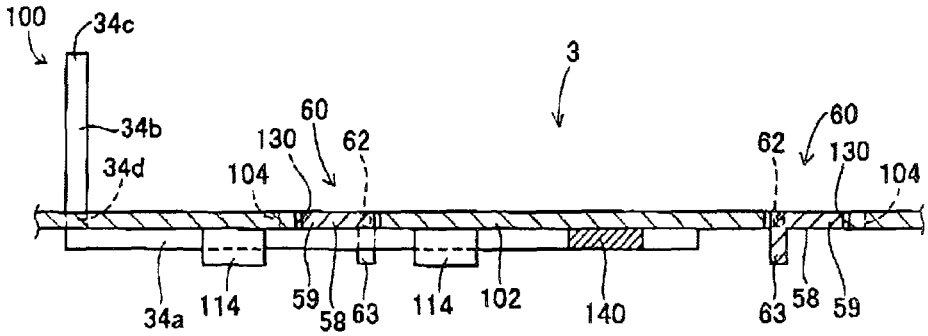
FIG. 12 is a cross-sectional view taken along line 12-12 in FIG. 11.

The support plate 102 includes an opening 130 formed therein so that the guide plate portion 59 is accommodated in the opening 130 in a state in which the sub-side guide 60 is in the lying position (shown in FIGS. 11 and 12). The support plate 102 also includes recessed portions (not shown) provided on a periphery of the opening 130 thereof The shaft portions 62 are rotatably supported by the recessed portions respectively.

Figure 13:
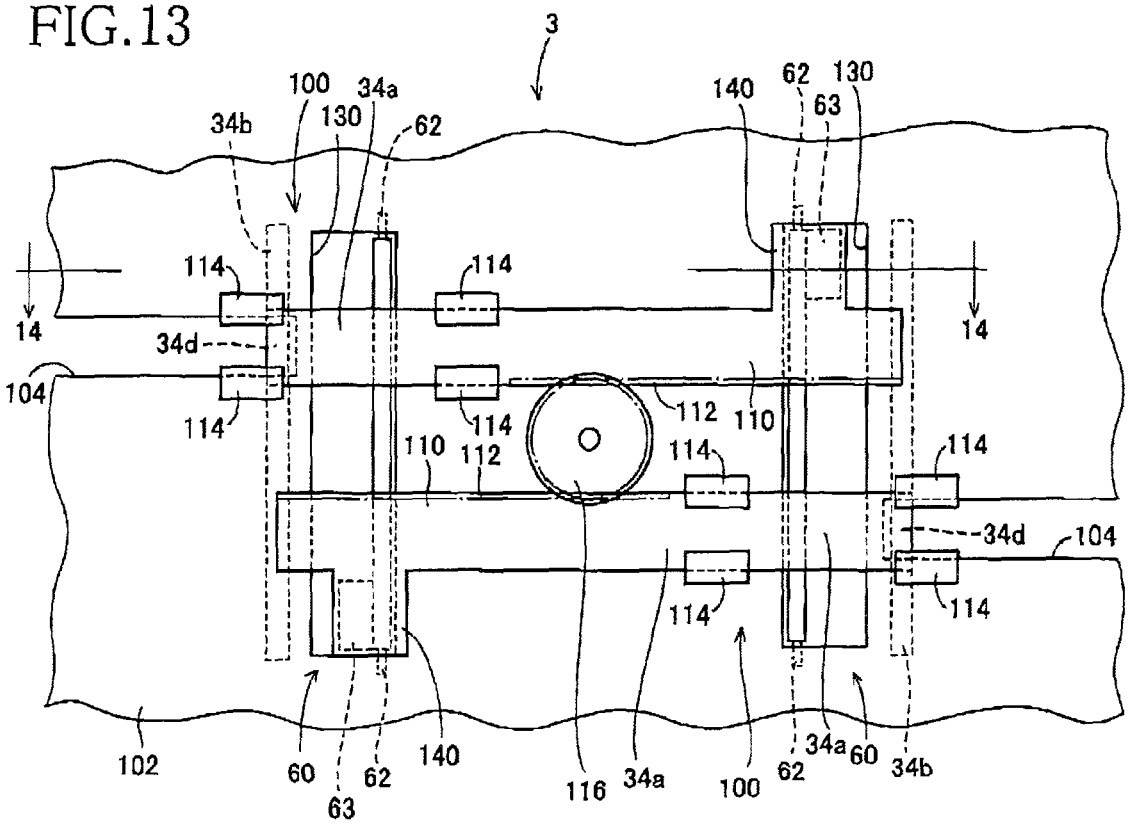
FIG. 13 is a plan view schematically showing the sub-side guide in a standing position along with the main side guide.
Figure 14:
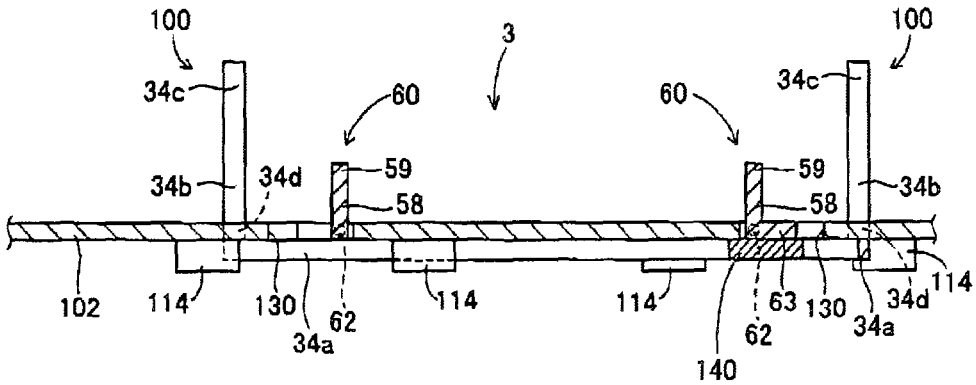
FIG. 14 is a cross-sectional view taken along line 14-14 in FIG. 13.

As shown in FIGS. 11 and 13, the side guide member 100 also includes a driving portion 140 provided on the rack member 110 thereof for driving the driven portion 63 of the sub-side guide 60 so as to raise the sub-side guide when the side guide member 100 is moved toward a widthwise middle portion of the support plate 102 (shown in FIGS. 13 and 14). The driving portion 140 is provided on the rack member 110 on the side opposite to the rack teeth 112.

As shown in FIGS. 13 and 14, the driving portion 140 engages the driven portion 63 so as to pivot the sub-side guide 60 from the lying position to the standing position when the side guide member 100 is moved toward a widthwise middle portion of the support plate 102. As shown in FIGS. 11 and 12, when the side guide member 100 is moved away from the widthwise middle portion of the support plate 102, the driven portion 63 disengages the driving portion 140, so that the sub-side guide 60 automatically pivots toward the lying position because of its own weight, to be accommodated in the opening 130.

In each of the above-described embodiments, the image recording apparatus 1 employs the plurality of sheet-supply cassettes 3, 30. However, the principle of the present invention is applicable to an image recording apparatus employing a single sheet-supply cassette only.

It is to be understood that the present invention may be embodied with various changes, modifications, and improvements that may occur to a person skilled in the art without departing from the spirit and scope of the invention defined in the appended claims.

What is claimed is:

1. A sheet-supply apparatus, comprising:

a sheet accommodating portion which includes a support portion that supports, on a support surface thereof, a plurality of cut sheets such that the cut sheets are stacked on each other;

a sheet-supply roller which is adapted to supply the cut sheets accommodated in the sheet accommodating portion, one by one in a sheet-supply direction;

a main side guide which is slidably movable on the support portion in a widthwise direction of the sheet accommodating portion perpendicular to the sheet-supply direction and which guides a side edge of each of the cut sheets accommodated in the sheet accommodating portion, the side edge being parallel to the sheet-supply direction;

a sub-side guide which is located inside of the main side guide in the widthwise direction;

a pivoting mechanism which automatically pivots the sub-side guide about a pivot axis between a standing position and a lying position in response to the widthwise sliding movement of the main side guide; and a sliding mechanism configured to slide the sub-side guide in the widthwise direction while maintaining the standing position of the sub-side guide in response to the widthwise sliding movement of the main side guide.

2. The sheet-supply apparatus according to claim 1, wherein the pivot axis extends parallel to the sheet-supply direction at one of opposite ends of the sub-side guide.

3. The sheet-supply apparatus according to claim 1, wherein the pivoting mechanism comprises a movement converting mechanism which converts at least a part of the widthwise sliding movement of the main side guide into a pivoting movement of the sub-side guide between the standing position and the lying position.

4. The sheet-supply apparatus according to claim 3, wherein the main side guide comprises: a bottom plate which is substantially parallel to the support surface of the support portion of the sheet accommodating portion; and a side plate which stands upright from the bottom plate for guiding the side edge of each of the cut sheets, and wherein the sub-side guide is attached to the bottom plate at a portion thereof which is located inside of the side plate in the widthwise direction so as to be pivotable about the pivot axis between the standing position and the lying position.

5. The sheet-supply apparatus according to claim 4, wherein the sub-side guide comprises a driven portion, and wherein the sheet accommodating portion includes a driving portion provided on the support portion thereof for driving the driven portion of the sub-side guide so as to raise the sub-side guide when the main side guide is moved toward a widthwise middle portion of the support portion, and wherein the driven portion and the driving portion constitute the movement converting mechanism.

6. The sheet-supply apparatus according to claim 5, wherein the sub-side guide comprises: a base portion extending along the pivot axis; a guide plate portion extending from the base portion in a direction perpendicular to the pivot axis; and the driven portion extending from the base portion in a direction perpendicular to the guide plate portion, and wherein the driven portion is arranged to be substantially parallel to the bottom plate of the main side guide in a state in which the guide plate portion is in the standing position and to extend substantially perpendicularly to the bottom plate on one side of the bottom plate opposite to the side plate in a state in which the guide plate portion is in the lying position.

7. The sheet-supply apparatus according to claim 5, wherein the driving portion is a cam including: an inclined portion which is inclined with respect to the widthwise direction; and a parallel portion which extends in the widthwise direction while the driven portion includes a cam follower which engages the cam, and wherein the inclined portion engages the cam follower to pivot the sub-side guide from the lying position to the standing position and the parallel portion maintains the sub-side guide in the standing position.

8. The sheet-supply apparatus according to claim 7, wherein a part of the driven portion comprises the cam follower to be pressed against a cam surface of the cam because of a weight of the driven portion.

9. The sheet-supply apparatus according to claim 1, wherein the main side guide is provided in a pair on the support portion to move symmetrically toward and away from each other in the widthwise direction and the sub-side guide is provided for each of the pair of the main side guides.

10. The sheet-supply apparatus according to claim 4, wherein the sub-side guide comprises: a base portion extending along the pivot axis; a guide plate portion extending from the base portion in a direction perpendicular to the pivot axis; and a driven portion extending from the base portion in a direction perpendicular to the guide plate portion, and wherein the main side guide comprises an opening formed in the bottom plate so that the guide plate portion is accommodated in the opening in a state in which the sub-side guide is in the lying position.

11. The sheet-supply apparatus according to claim 10, further comprising a first engaging portion provided on a periphery of the opening and a second engaging portion provided on a periphery of the guide plate portion, and wherein the first engaging portion engages the second engaging portion to limit the pivotal movement of the sub-side guide in a direction from the standing position to the lying position.

12. The sheet-supply apparatus according to claim 10, wherein the sub-side guide has shaft portions which protrude from respective opposite ends of the base portion thereof along the pivot axis while the main side guide has recessed portions provided on a periphery of the opening thereof, and wherein the shaft portions are supported respectively by the recessed portions in a way that is rotatable and detachable upward and the sub-side guide is supported rotatably by the bottom plate.

13. The sheet-supply apparatus according to claim 1, further comprising:

a first medium cassette as the sheet accommodating portion which includes a first support portion as the support portion having a first support surface for supporting a plurality of first recording media as the cut sheets so as to be stacked on each other; and a second medium cassette which is provided above the first support portion of the first medium cassette so as to be movable relative to the first medium cassette between an advanced position where the second medium cassette is located downstream in the sheet-supply direction relative to the first medium cassette and a retracted position where the second medium cassette is located upstream in the sheet-supply direction relative to the first medium cassette, and which includes a second support portion having a second support surface for supporting a plurality of second recording media so as to be stacked on each other, the second recording media having a width as measured in the widthwise direction perpendicular to the sheet-supply direction that is smaller than a width of the first recording media as measured in the widthwise direction, wherein the sheet-supply roller which is adapted to supply the first recording media one by one in the sheet-supply direction in a state in which the second medium cassette is located at the retracted position and to supply the second recording media one by one in the sheet-supply direction in a state in which the second medium cassette is located at the advanced position, and wherein the sub-side guide has a height that allows itself to be located beneath the second support portion of the second medium cassette in a state in which the sub-side guide is in the standing position.

14. The sheet-supply apparatus according to claim 13, wherein the second support portion further comprises: a non-pivotable portion which is attached to the first medium cassette and receives a pressure from the sheet-supply roller contacting the second recording media; and a pivotable portion which is pivotable between a position where at least a part of a space above the first support portion is exposed and a position where said at least a part of a space is covered, and wherein the non-pivotable portion is disposed at a downstream portion of the second support portion in the sheet-supply direction and the pivotable portion is pivotable at a end portion thereof nearer to the non-pivotable portion about a pivot axis extending in the widthwise direction.

15. The sheet-supply apparatus according to claim 13, wherein the second medium cassette is attached undetachably to the first medium cassette and is movable in the sheet supply direction.

16. The sheet-supply apparatus according to claim 13, wherein the second support portion includes a discharged-medium receiving portion which is formed integrally with an upstream portion of the second support portion in the sheet-supply direction adjacent to the pivotable portion, for receiving the recording media discharged from the first medium cassette.

17. The sheet-supply apparatus according to claim 1, wherein the pivoting mechanism automatically pivots the sub-side guide about the pivot axis between the standing position and the lying position mechanically, in conjunction with the widthwise sliding movement of the main guide.

18. The sheet-supply apparatus according to claim 17, wherein the sub-side guide is slidably movable in the widthwise direction in conjunction with the main side guide.

19. The sheet-supply apparatus according to claim 1, wherein the pivoting mechanism automatically pivots the sub-side guide about the pivot axis between the standing position and the lying position in response to the widthwise sliding movement, at a predetermined position of the main side guide.

20. A sheet-supply apparatus comprising:

a sheet accommodating portion which includes a support portion that supports, on a support surface thereof, a plurality of cut sheets such that the cut sheets are stacked on each other;

a sheet-supply roller which is adapted to supply the cut sheets accommodated in the sheet accommodating portion, one by one in a sheet-supply direction;

a main side guide which is slidably movable on the support portion in a widthwise direction of the sheet accommodating portion perpendicular to the sheet-supply direction and which guides a side edge of each of the cut sheets accommodated in the sheet accommodating portion, the side edge being parallel to the sheet-supply direction;

a sub-side guide which is located inside of the main side guide in the widthwise direction; and a pivoting mechanism which automatically pivots the sub-side guide about a pivot axis between a standing position and a lying position in response to the widthwise sliding movement of the main side guide;

a first medium cassette as the sheet accommodating portion which includes a first support portion as the support portion having a first support surface for supporting a plurality of first recording media as the cut sheets so as to be stacked on each other; and a second medium cassette which is provided above the first support portion of the first medium cassette so as to be movable relative to the first medium cassette between an advanced position where the second medium cassette is located downstream in the sheet-supply direction relative to the first medium cassette and a retracted position where the second medium cassette is located upstream in the sheet-supply direction relative to the first medium cassette, and which includes a second support portion having a second support surface for supporting a plurality of second recording media so as to be stacked on each other, the second recording media having a width as measured in the widthwise direction perpendicular to the sheet-supply direction that is smaller than a width of the first recording media as measured in the widthwise direction, wherein the sheet-supply roller which is adapted to supply the first recording media one by one in the sheet-supply direction in a state in which the second medium cassette is located at the retracted position and to supply the second recording media one by one in the sheet-supply direction in a state in which the second medium cassette is located at the advanced position, wherein the sub-side guide has a height that allows itself to be located beneath the second support portion of the second medium cassette in a state in which the sub-side guide is in the standing position, wherein the second support portion of the second medium cassette has a width as measured in the widthwise direction that is made smaller at a downstream portion thereof than at an upstream portion thereof, and wherein the side plate of the main side guide is disposed on a side of the downstream portion of the second support portion having a smaller width.

* * * * *